US009147976B2

(12) United States Patent
Ao et al.

(10) Patent No.: US 9,147,976 B2
(45) Date of Patent: Sep. 29, 2015

(54) CONNECTOR AND SIGNAL LINE STRUCTURE

(75) Inventors: Hitoshi Ao, Yao (JP); Hayato Kondo, Yao (JP)

(73) Assignee: HOSIDEN CORPORATION, Osaka (JP)

( * ) Notice: Subject to any disclaimer, the term of this patent is extended or adjusted under 35 U.S.C. 154(b) by 44 days.

(21) Appl. No.: 13/488,583

(22) Filed: Jun. 5, 2012

(65) Prior Publication Data

US 2012/0329322 A1 Dec. 27, 2012

(30) Foreign Application Priority Data

Jun. 23, 2011 (JP) ..... 2011-139754

(51) Int. Cl.

| | |
|---|---|
| ***H01R 13/648*** | (2006.01) |
| ***H01R 13/6474*** | (2011.01) |
| ***H01R 13/6471*** | (2011.01) |
| *H01R 12/72* | (2011.01) |
| *H01R 13/6594* | (2011.01) |

(52) U.S. Cl.

CPC ..... *H01R 13/6474* (2013.01); *H01R 13/6471* (2013.01); *H01R 12/724* (2013.01); *H01R 13/6594* (2013.01)

(58) Field of Classification Search

CPC ..... H01R 13/65802; H01R 23/7073
USPC ..... 439/607.01, 607.11, 607.13, 660
See application file for complete search history.

(56) References Cited

U.S. PATENT DOCUMENTS

| | | | | |
|---|---|---|---|---|
| 4,653,825 | A * | 3/1987 | Olsson | 439/295 |
| 6,328,602 | B1 | 12/2001 | Yamasaki et al. | |
| 7,467,977 | B1 * | 12/2008 | Yi et al. | 439/607.01 |
| 7,878,847 | B2 * | 2/2011 | He et al. | 439/541.5 |
| 8,096,835 | B2 * | 1/2012 | Dufour et al. | 439/620.05 |
| 2010/0173524 | A1 | 7/2010 | Zhu et al. | 439/607.01 |
| 2010/0248552 | A1 | 9/2010 | He et al. | |

FOREIGN PATENT DOCUMENTS

| | | | |
|---|---|---|---|
| EP | 2 251 938 | | 11/2010 |
| FR | 2795243 | A1 | 12/2000 |
| JP | 2010-287560 | A1 | 12/2010 |
| WO | 2008/156850 | | 12/2008 |
| WO | 2009/025868 | | 2/2009 |

OTHER PUBLICATIONS

Extended European Search Report mailed Nov. 5, 2012 in counterpart application No. 12250123.2 (6 pages).

Notification of Reasons for Refusal, Issued in the Corresponding JP Patent Application No. 2011-139754, on Dec. 24, 2014.

European Office Action, for the Corresponding EP Application No. 12250123.2, mailed on May 29, 2015.

* cited by examiner

*Primary Examiner* — Phuong T Nguyen

(74) *Attorney, Agent, or Firm* — Kratz, Quintos & Hanson, LLP

(57) ABSTRACT

The present invention provides a connector including a body having insulation properties and a terminal group. The terminal group includes a pair of first signal terminals, a second signal terminal, and a third terminal that are arrayed in a row along a first direction in the body. The first signal terminals are adjacent to each other in the first direction. The third terminal is disposed between one of the first signal terminals and the second signal terminal. The third terminal includes a shielding portion extending in a direction crossing the first direction.

13 Claims, 20 Drawing Sheets

CONNECTOR AND SIGNAL LINE STRUCTURE

The present application claims priority under 35 U.S.C. §119 of Japanese Patent Application No. 2011-139754 filed on Jun. 23, 2011, the disclosure of which is expressly incorporated by reference herein in its entity.

BACKGROUND OF THE INVENTION

1. Technical Field

The present invention relates to connectors and signal line structures.

2. Background Art

JP 2010-287560A discloses a connector with a terminal group arrayed in a row. The terminal group has a plurality of pairs of differential signal terminals and a plurality of ground terminals. The ground terminals are disposed between the pairs of differential signal terminals to prevent crosstalk between the pairs of differential signal terminals.

SUMMARY OF INVENTION

The above conventional connector may suffer from crosstalk between adjacent differential signal terminals with ground terminals interposed therebetween. This is due to part of electromagnetic waves (electromagnetic field energy) radiated from the differential signal terminal at an angle with respect to the arraying direction of the terminal group, wherein the angled electromagnetic waves leap over the ground terminals and interfere with the differential signal terminals adjacent to the ground terminal.

The present invention has been contrived in view of the above circumstances. The invention provides a connector capable of reducing crosstalk between signal terminals. The invention also provides a signal line structure capable of reducing crosstalk between signal lines.

A connector according to an aspect of the invention includes a body having insulation properties and a terminal group. The terminal group includes a pair of first signal terminals, a second signal terminal, and a third terminal that are arrayed in a row along a first direction in the body. The first signal terminals are adjacent to each other in the first direction. The third terminal is disposed between one of the first signal terminals and the second signal terminal. The third terminal includes a shielding portion extending in a direction crossing the first direction.

According to this aspect of the invention, the shielding portion of the third terminal extends in a direction crossing the first direction that is the arraying direction of the terminal group. The shielding portion can shield electromagnetic waves (electromagnetic field energy) radiated at an angle with respect to the first direction from the first signal terminal or the second signal terminal. Therefore, the invention can reduce crosstalk between the first and second signal terminals adjacent to each other with the third terminal interposed therebetween.

The second signal terminal of the terminal group may include a pair of second signal terminals adjacent to each other in the first direction. The third terminal may be disposed between the one of the first signal terminals and one of the second signal terminals.

The shielding portion may be a cut-raised section formed by cutting and raising a portion of the third terminal. According to this aspect of the invention, as the shielding portion is a cut-raised section formed by cutting and raising a portion of the third terminal, the connector can be fabricated with a reduced number of components, as compared with a case in which the shielding portion is a separate component.

Alternatively, the shielding portion may be a bent section being continuous with and bent with respect to a portion of the third terminal. According to this aspect of the invention, as the shielding portion a bent section being continuous with and bent with respect to a portion of the third terminal, the connector can be fabricated with a reduced number of components, as compared with a case in which the shielding portion is a separate component.

The third terminal may include an extended portion including said portion of the third terminal and extending in the first direction and a remaining portion excluding the extended portion. The extended portion may have a larger dimension in the first direction than the remaining portion.

According to this aspect of the invention, as the shielding portion is a cut-raised section or a bent section formed by cutting-and-raising or bending the extended portion extending in the first direction, it is possible to increase the height dimension of the shielding portion. The shielding portion with a large height dimension can reduce crosstalk further effectively.

A relation "$\beta>\alpha$" may hold true, where $\beta$ is a distance in the first direction between a centerline of said portion of the third terminal and a centerline of a portion of each of the first and second signal terminals adjacent to the portion of the third terminal, $\alpha$ is a distance in the first direction between the centerlines of the portions of the first signal terminals.

According to this aspect of the invention, with the relation $\beta>\alpha$, it is possible to increase the dimension in the first direction of the extended portion. As the shielding portion is a cut-raised section or a bent section formed by cutting-and-raising or bending the extended portion extending in the first direction, it is possible to increase the height dimension of the shielding portion. The shielding portion with a large height dimension can reduce crosstalk further effectively. Also, with the relation $\beta>\alpha$, this aspect of the invention eases batch fabrication of the first and second signal terminals and the third terminal having the shielding portion by press molding a single metal plate. As a result, the connector can be fabricated with a reduced cost.

The first signal terminals may each have a curved portion that may be curved to one side in the first direction to detour the portion of the third terminal. The second signal terminal may have a curved portion that may be curved to the other side in the first direction to detour the portion of the third terminal.

According to this aspect of the invention, as the first signal terminals each have a curved portion that is curved to one side in the first direction to extend outside the portion of the third terminal, and as the second signal terminal has a curved portion that is curved to the other side in the first direction to extend outside the portion of the third terminal, it is possible to increase the height dimension of the shielding portion provided in the portion of the third terminal. The shielding portion with a large height dimension can reduce crosstalk further effectively. In addition, this aspect of the invention eases batch fabrication of the first and second signal terminals and the third terminal having the shielding portion by press molding a single metal plate. As a result, the connector can be fabricated with a reduced cost.

the first and second signal terminals may each include a retention portion, a contact portion, and a hanging portion. The retention portion may extend in a second direction perpendicular to the first direction, be held in the body, and include first and second ends in the second direction. The contact portion may extend in the second direction from the first end of the retention portion. The hanging portion may extend in a third direction perpendicular to the first and second directions from the second end of the retention portion. The third terminal may further include a retention portion, a contact portion, and a hanging portion. The retention portion may extend in the second direction, be held in the body, and include first and second ends in the second direction. The contact portion may extend in the second direction from the first end of the retention portion. The hanging portion may extend in the third direction from the second end of the retention portion. The said portion of the third terminal may be provided in at least one of the retention portion and the hanging portion of the third terminal.

At least one of relations "$\delta 1>\gamma 1$" and "$\delta 2>\gamma 2$" may hold true, where $\gamma 1$ is a distance in the first direction between the hanging portions of the first signal terminals, $\gamma 2$ is a distance in the first direction between the retention portions of the first signal terminals, $\delta 1$ is a distance in the first direction between the hanging portion of the third terminal and the hanging portion of each of the first and second signal terminals adjacent to the third terminal, and $\delta 2$ is a distance in the first direction between the retention portion of the third terminal and the retention portion of each of the first and second signal terminals adjacent to the third terminal. This aspect of the invention, with the relations $\delta 1>\gamma 1$ and/or $\delta 2>\gamma 2$, can reduce electromagnetic waves (electromagnetic field energy) radiated at an angle to the first direction from the first or second signal terminals interfering with the second signal terminal or first signal terminal, respectively. Therefore, it is possible to further reduce crosstalk between the first and second signal terminals adjacent to each other with the third terminal interposed therebetween.

A signal line structure of the invention includes a pair of first signal lines, a second signal line, and a third line, which are arrayed in a row along a first direction. The pair of first signal lines are adjacent to each other in the first direction. The third line is disposed between one of the first signal lines and the second signal line, the third line including a shielding portion extending in a direction crossing the first direction.

According to this aspect of the invention, the shielding portion of the third line extends in a direction crossing the first direction that is the arraying direction. The shielding portion can shield electromagnetic waves (electromagnetic field energy) radiated at an angle with respect to the first direction from the first signal lines or the second signal line. Therefore, it is possible to reduce crosstalk between the first and second signal lines adjacent to each other with the third line interposed therebetween.

The second signal line may include a pair of second signal lines that are adjacent to each other in the first direction. The third line may be disposed between the one of the first signal lines and one of the second signal lines.

DESCRIPTION OF EMBODIMENTS

A connector according to Embodiment 1 of the present invention will be described below with reference to FIGS. 1A to 8B.

Embodiment 1

A connector shown in FIGS. 1A to 2C is a receptacle connector of dual in-line package (DIP) type for connection to a circuit board (not shown). The receptacle connector is adapted to receive a mating plug connector from a second direction Y. The connector includes a body 100, a first terminal group T1, a second terminal group T2 (corresponding to the terminal group in the claims), and a shield case 300. The respective components of the connector will be described below in detail. For the convenience of explanation, FIGS. 1A to 3A shows a first direction as X, which is the widthwise direction of the connector and the arraying direction of the second terminals T2, the second direction as Y, which is the lengthwise direction of the connector and the connecting direction of the plug connector, and a third direction as Z, which is the heightwise direction of the connector. The second direction Y is perpendicular to the first direction X, and the third direction Z is perpendicular to the first direction X and the second direction Y.

Figure 1A:
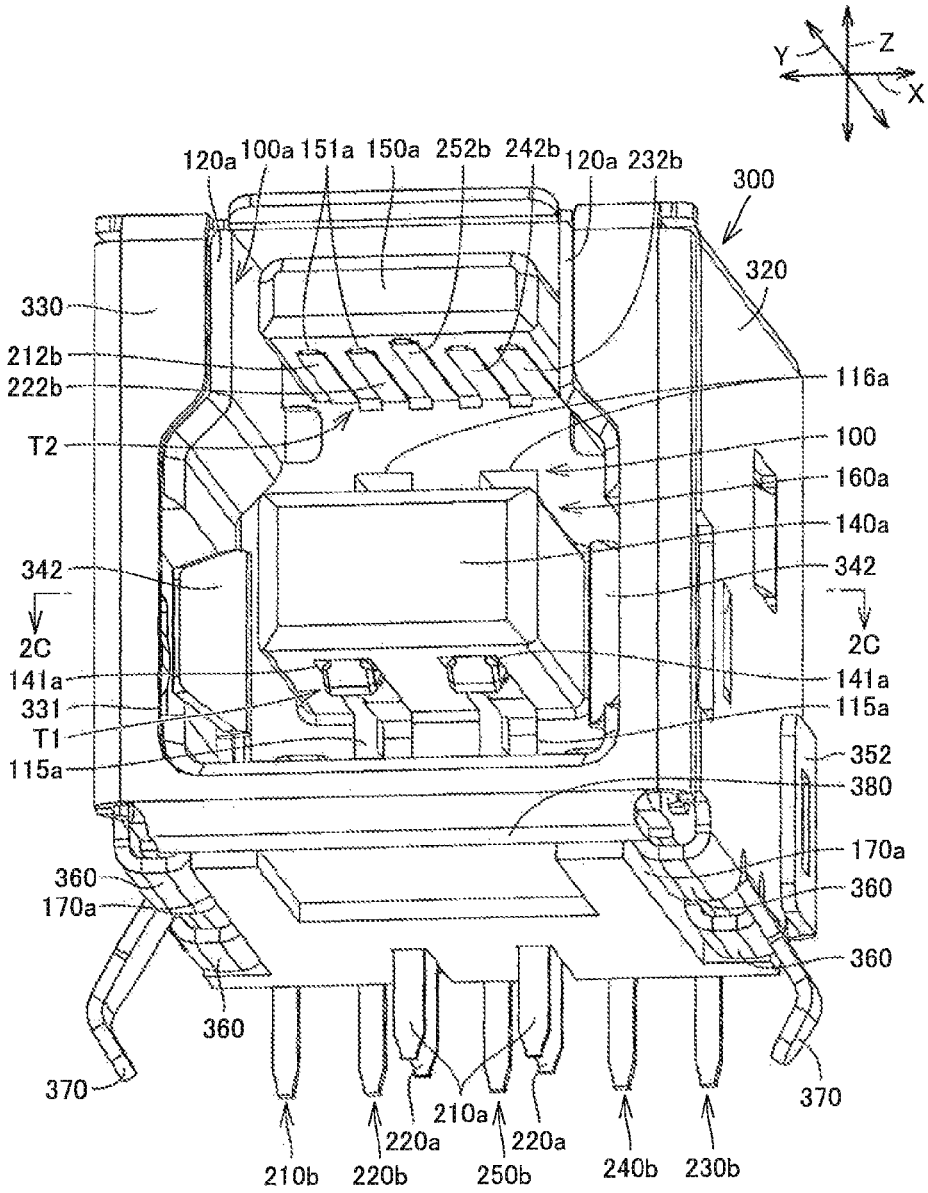
FIG. 1A is a schematic front, bottom, and right side perspective view of a connector according to Embodiment 1 of the invention.
Figure 1B:
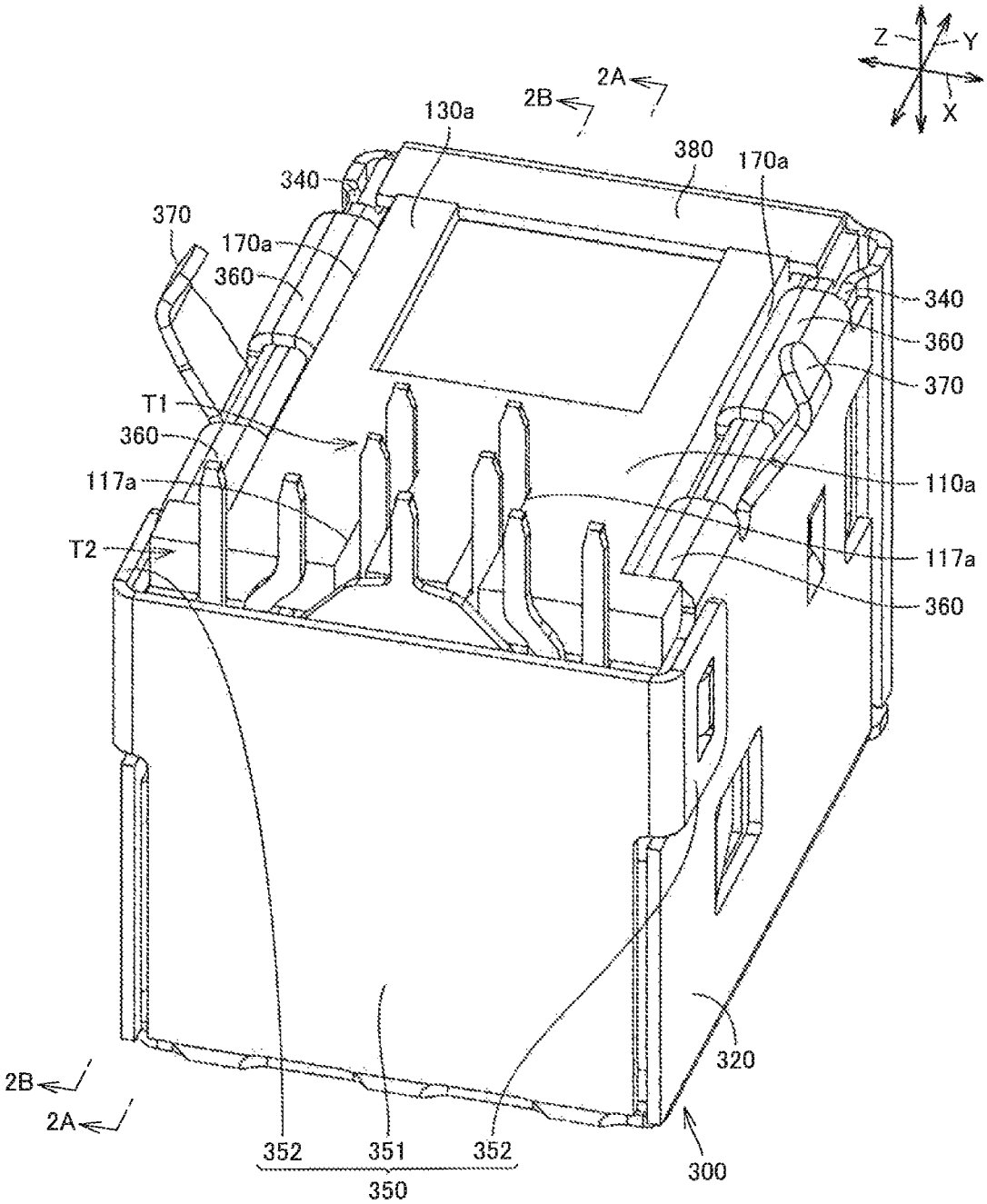
FIG. 1B is a schematic rear, bottom, and right side perspective view of the connector.
Figure 2A:
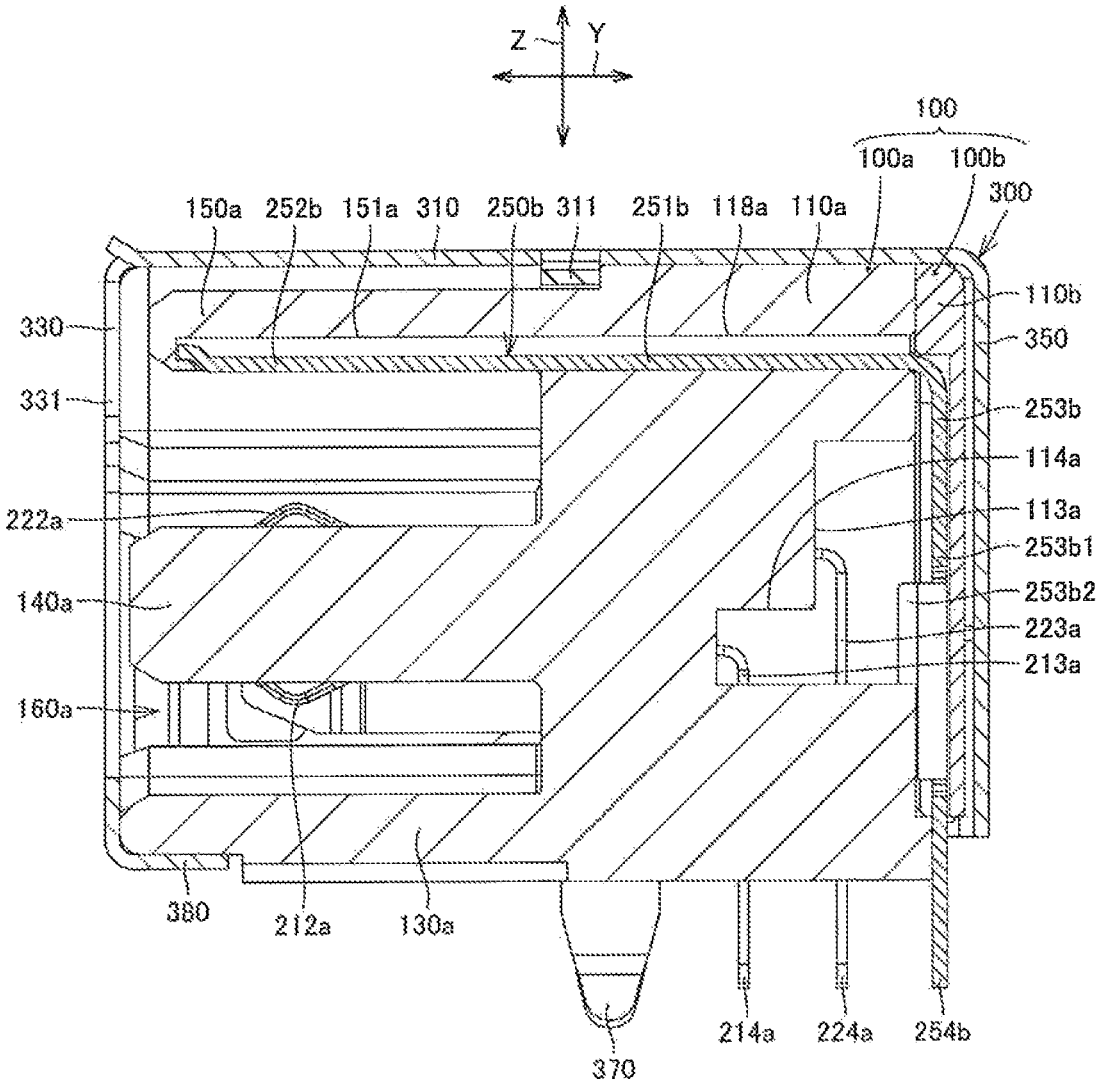
FIG. 2A is a cross-sectional view of the connector, taken along line 2A-2A in FIG. 1B.
Figure 2B:
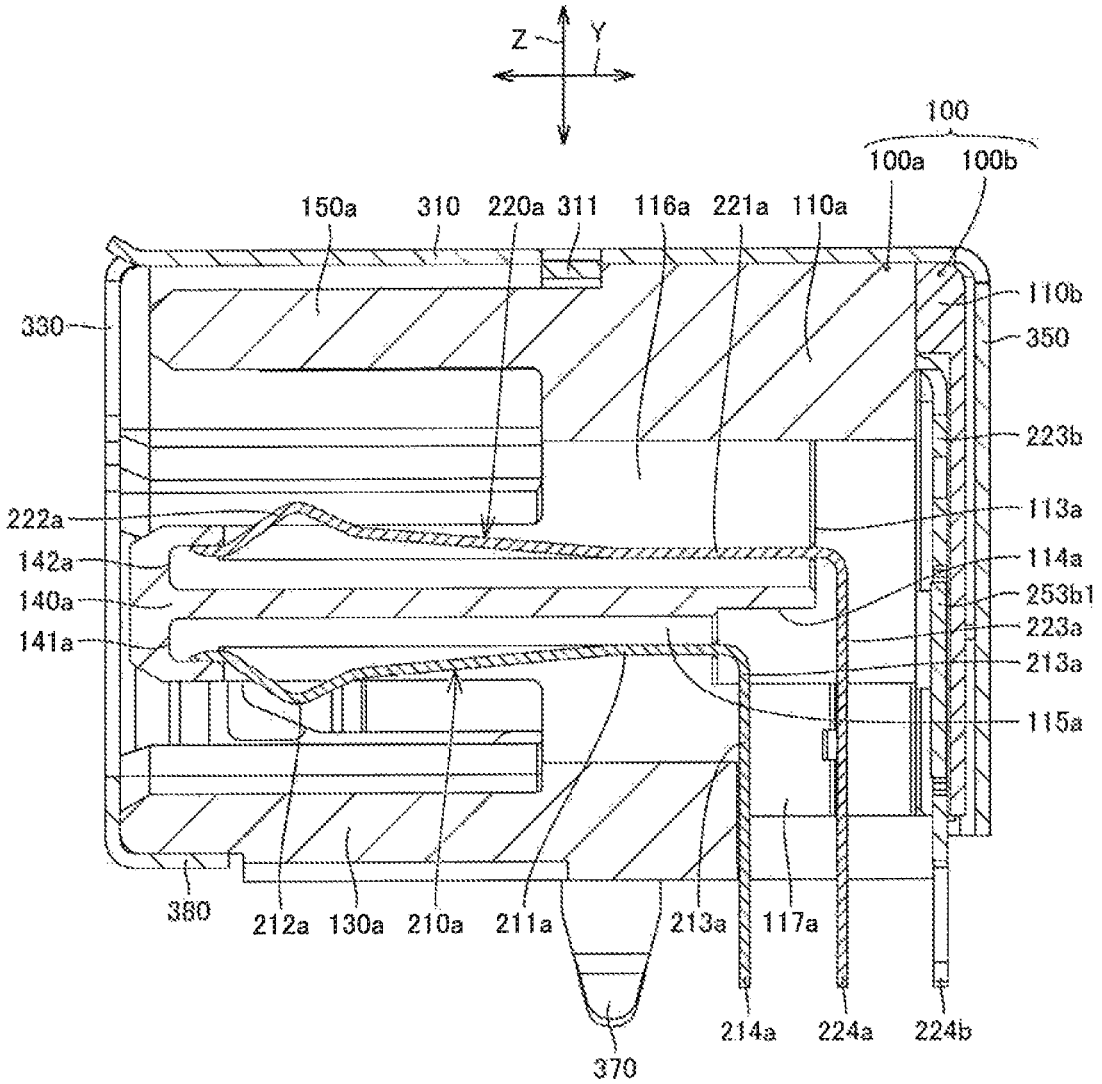
FIG. 2B is a cross-sectional view of the connector, taken along line 2B-2B in FIG. 1B.
Figure 2C:
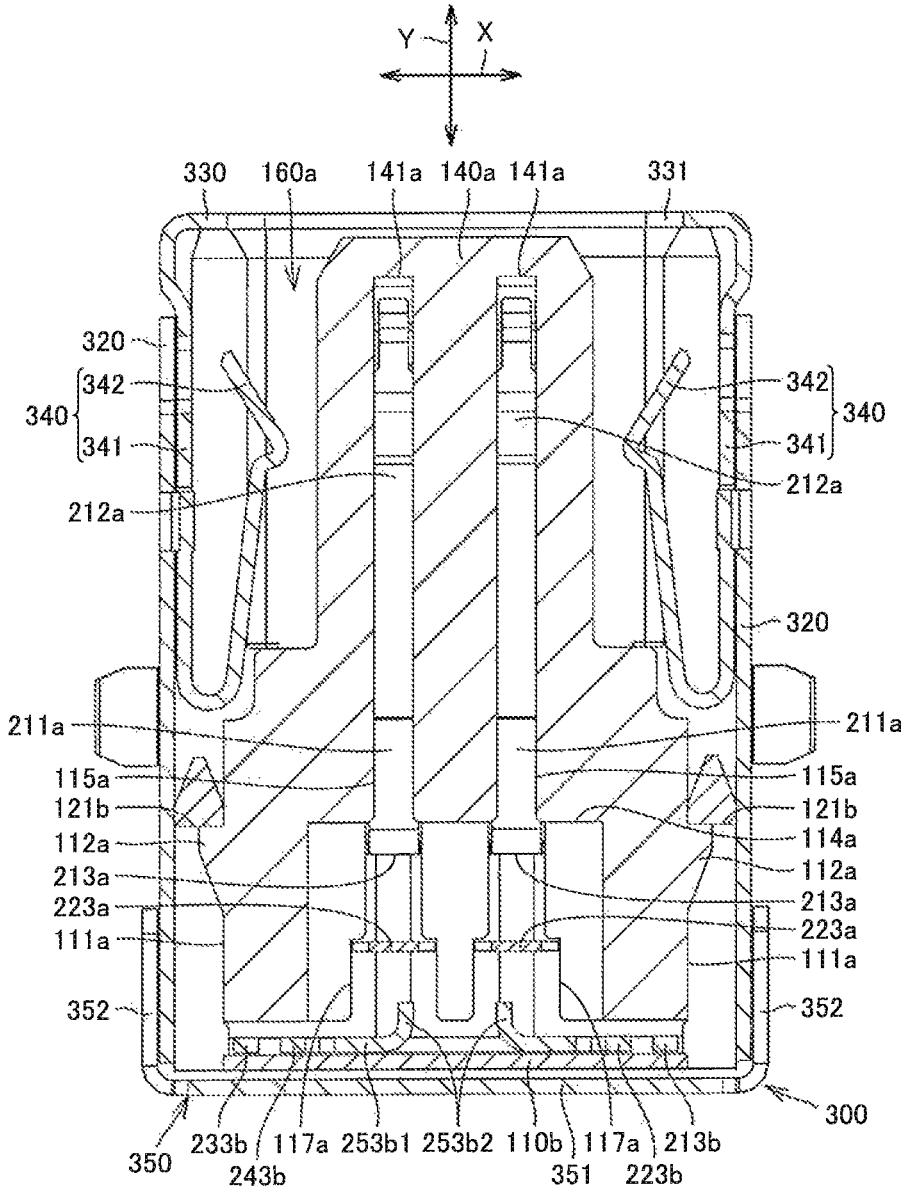
FIG. 2C is a cross-sectional view of the connector, taken along line 2C-2C in FIG. 1A.
Figure 3A:
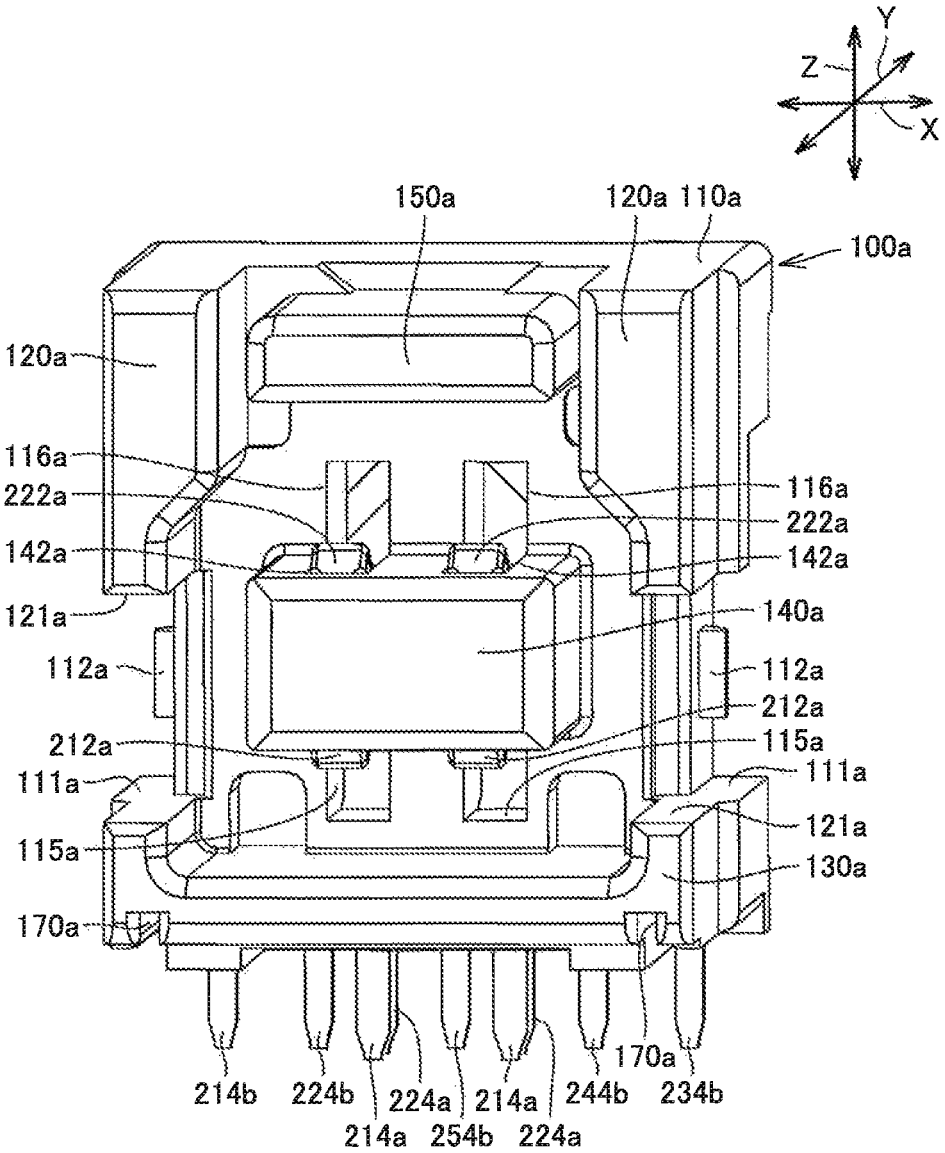
FIG. 3A is a schematic front, top, and right side perspective view of a main body and first and second terminal groups of the connector.
Figure 3B:
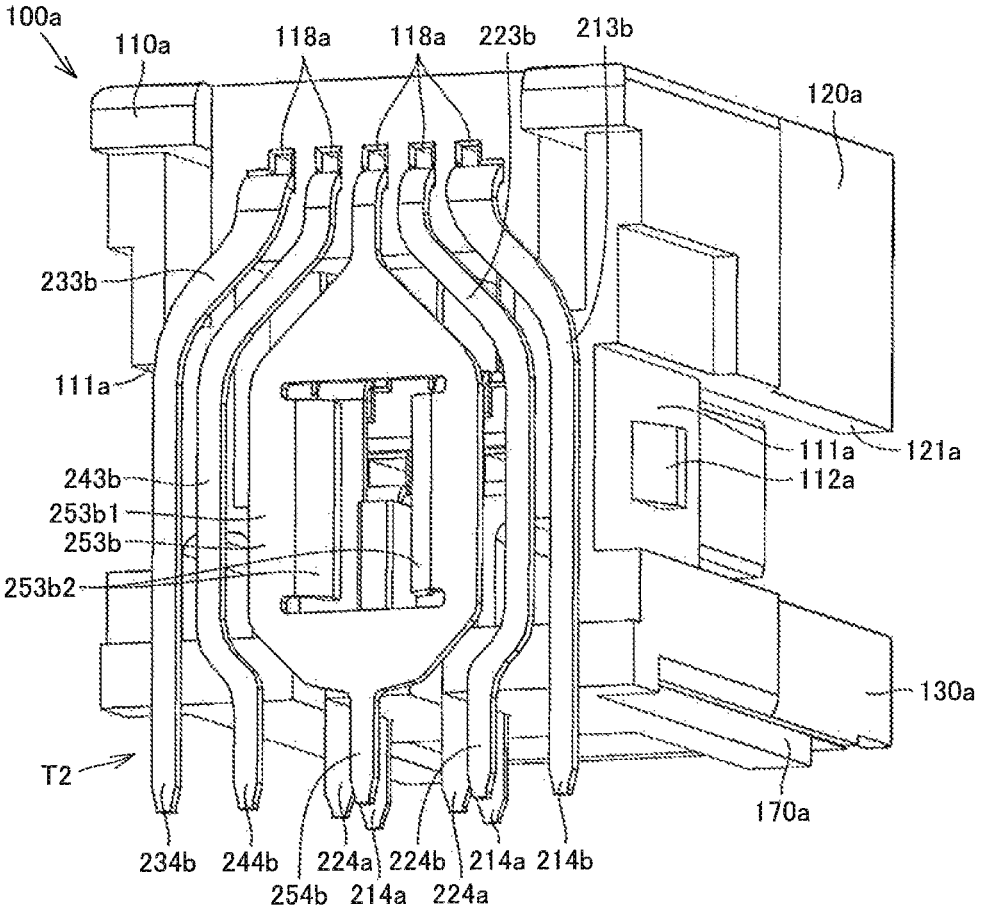
FIG. 3B is a schematic rear, bottom, and left side perspective view of the main body and the first and second terminal groups of the connector.
Figure 3C:
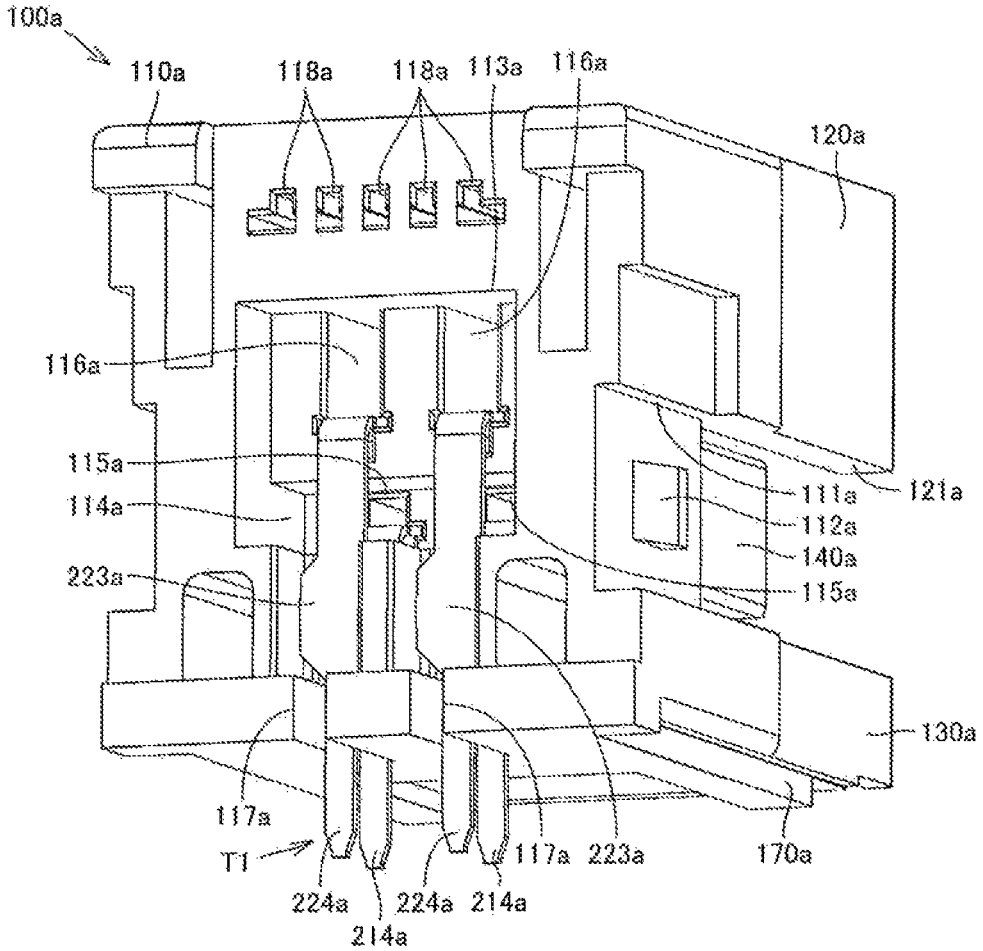
FIG. 3C is a schematic rear, bottom, and left side perspective view of the main body and the first terminal group of the connector.

As shown in FIGS. 2A and 2B, the body 100 includes a main body 100*a* and a cover 100*b*, which are made of an insulating resin. As shown in FIGS. 3A to 4C, the main body 100*a* has a base 110*a*, a pair of side walls 120*a*, a bottom wall 130*a*, a first projection 140*a*, and a second projection 150*a*.

The base 110*a* is a generally rectangular parallelepiped block. The base 110*a* has first and second faces (end faces) in the first direction X, third and fourth faces (front and rear faces) in the second direction Y, and fifth and sixth faces (upper and lower faces) in the third direction Z. The first and second faces of the base 110*a* are each formed with a locking recess 111*a*. A locking projection 112*a* is provided on the bottom of each locking recess 111*a*. The pair of side walls 120*a* extends in the second direction Y from opposite ends in the first direction X of the third face of the base 110*a*. The side walls 120*a* each have a lateral hole 121*a* communicating with the associated locking recess 111*a*. The first projection 140*a* in a square pillar shape projects in the second direction Y from the center of the third face of the base 110*a*. On the lower side of the first projection 140*a*, the bottom wall 130*a* in a planar shape extends in the second direction Y from the third face of the base 110*a*. The bottom wall 130*a* and the side walls 120*a* define a connecting hole 160*a* for receiving the plug connector. On the upper side of the first projection 140*a*, the second projection 150*a* in a planar shape extends in the second direction Y from the third face of the base 110*a*. The second projection 150*a* is located between the side walls 120*a*. It should be appreciated that one and the other side in the third direction Z correspond to the upper and lower sides, respectively.

Figure 4A:
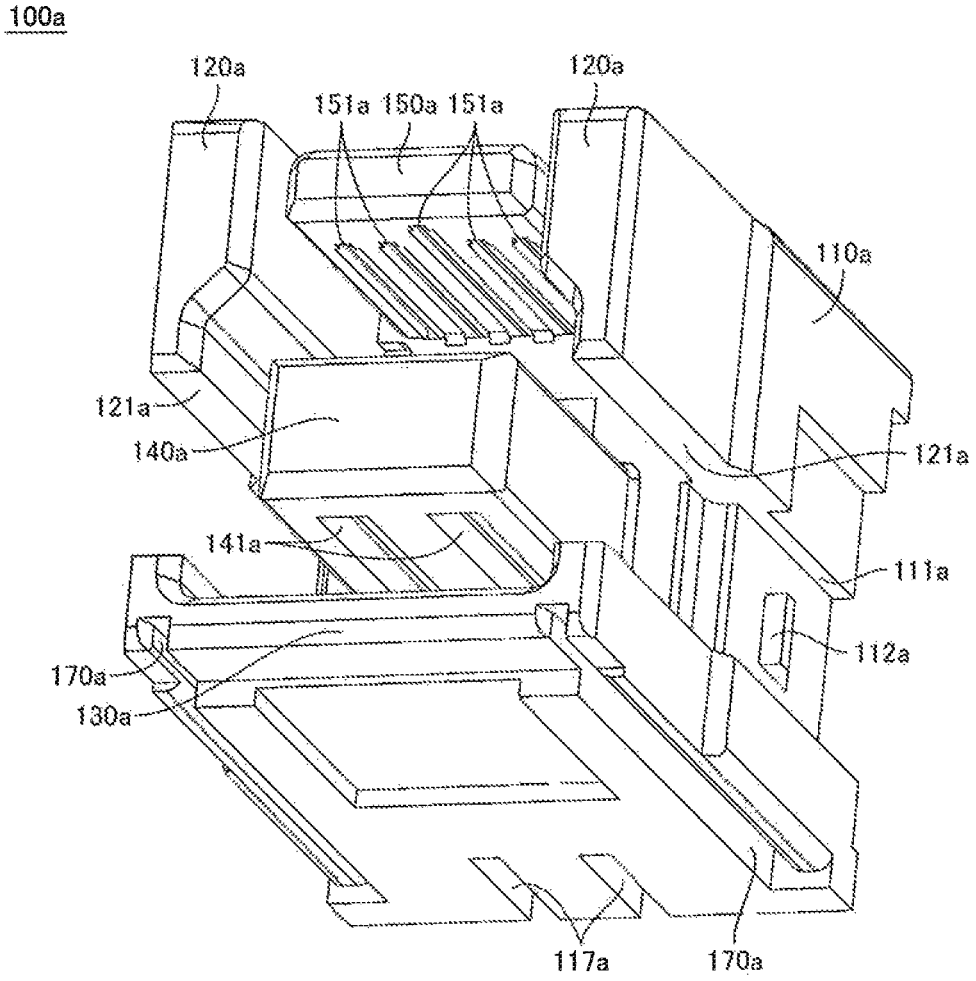
FIG. 4A is a schematic front, bottom, and right perspective view of the main body of the connector.
Figure 4B:
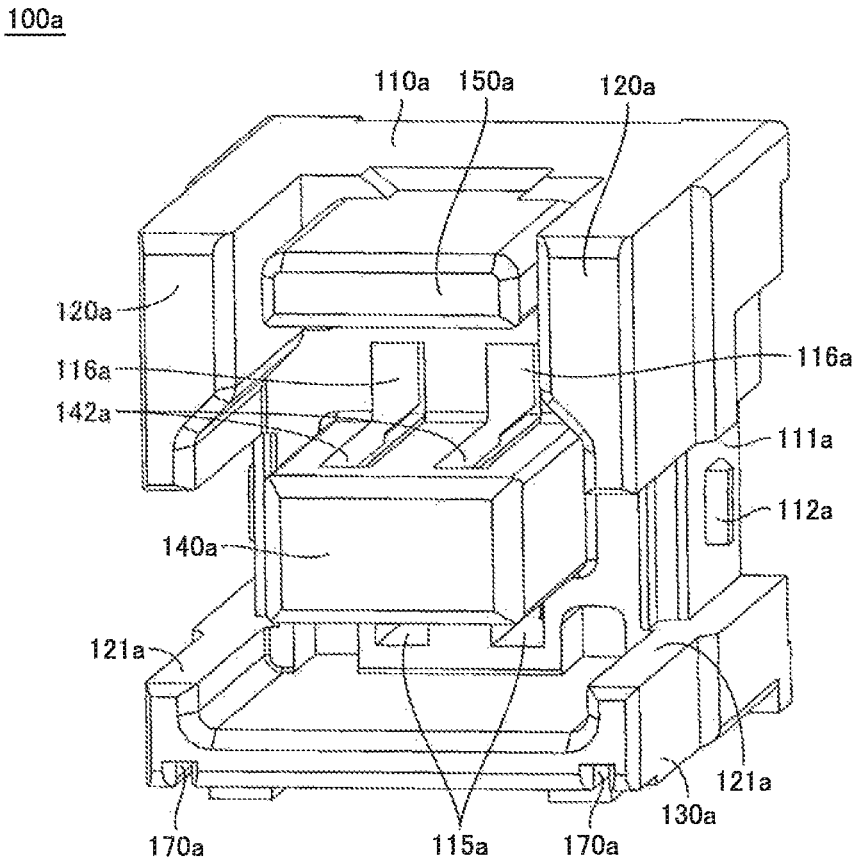
FIG. 4B is a schematic perspective view showing the front, top, and right side of the main body of the connector.
Figure 4C:
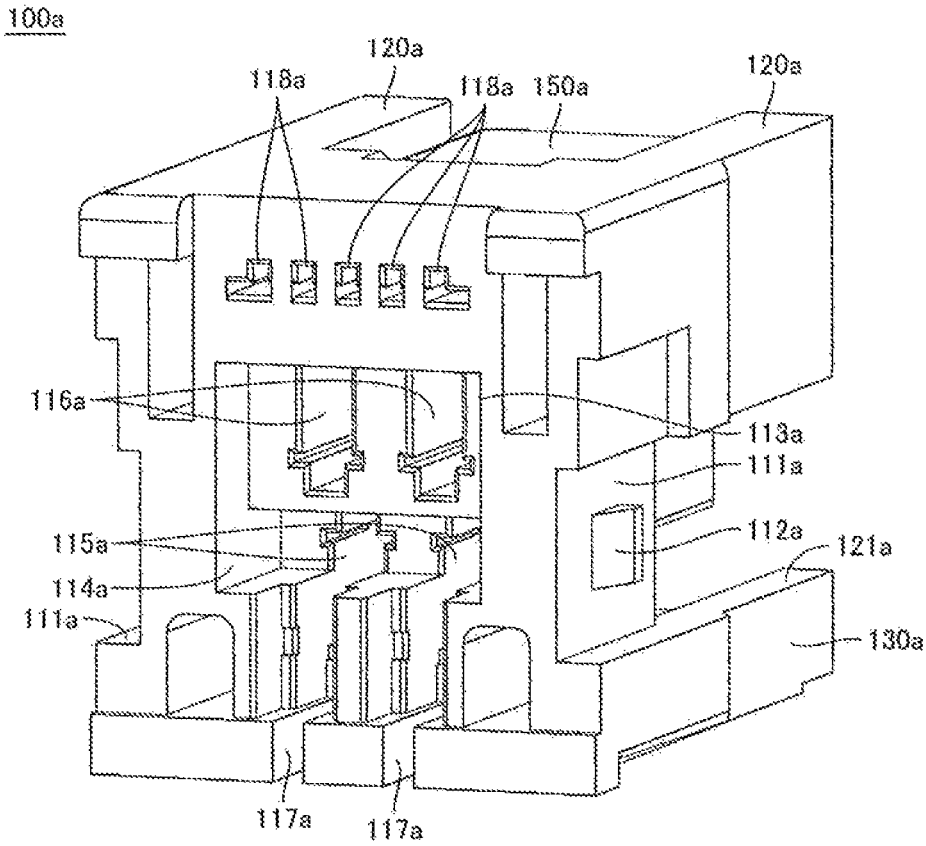
FIG. 4C is a schematic rear, top, and left side perspective view of the main body of the connector.

As shown in FIG. 4C, a first accommodating recess 113*a* in a rectangular shape is provided centrally of the fourth face of the base 110*a*. A second accommodating recess 114*a* in a rectangular shape is provided below and in communication with the first accommodating recess 113*a* in the fourth face of the base 110*a*. The second accommodating recess 114*a* has a larger depth dimension than the first accommodating recess 113*a*. The bottom of the second accommodating recess 114*a* is formed with a pair of first accommodating holes 115*a* arranged with spacing along the first direction X. The first accommodating holes 115*a* pass from the bottom of the second accommodating recess 114*a* to the third face of the base 110*a*. The bottom of the first accommodating recess 113*a* is formed with a pair of second accommodating holes 116*a* arranged with the same spacing as the first accommodating holes 115*a*. The second accommodating holes 116*a* pass from the bottom of the first accommodating recess 113*a* to the third face of the base 110*a*.

A pair of third accommodating recesses 117*a* extends in the third direction Z in the fourth face of the base 110*a*, below the second accommodating recess 114*a*. The third accommodating recesses 117*a* are open at their lower ends and communicate with the respective second accommodating recesses 114*a* at their upper ends. Above the first accommodating recess 113*a*, there are five third accommodating holes 118*a* in the fourth face of the base 110*a*, arranged with spacing along the first direction X. The third accommodating holes 118*a* pass through from the third face to the fourth face of the base 110*a*.

As shown in FIG. 4A, the bottom wall 130*a* has first and second faces (upper and lower faces) in the third direction Z. The second face of the bottom wall 130*a* is flush with the sixth face of the base 110*a*. A pair of engaging grooves 170*a* are provided at the ends in the first direction X of the second face of the bottom wall 130*a* and the sixth face of the base 110*a*. The engaging grooves 170*a* extend in the second direction Y and are open on one side in the second direction Y (front side).

As shown in FIGS. 4A and 4B, the first projection 140*a* has first and second faces in the third direction Z (upper and lower faces). The lower face (the second face) of the first projection 140*a* has a pair of first accommodating grooves 141*a* at the same spacing as and in communication with the first accommodating holes 115*a* of the base 110*a* (see FIGS. 2B and 2C). Similarly, the upper face (the first face) of the first projection 140*a* has a pair of second accommodating grooves 142*a* at the same spacing as and in communication with the second accommodating holes 116*a* of the base 110*a*. As shown in FIG. 4A, the second projection 150*a* has first and second faces in the third direction Z (upper and lower faces). The lower face (the second face) of the second projection 150*a* has five third accommodating grooves 151*a* at the same spacing as and in communication with the third accommodating holes 118*a* in the base 110*a*. (see FIGS. 2A and 2B).

Figure 5:
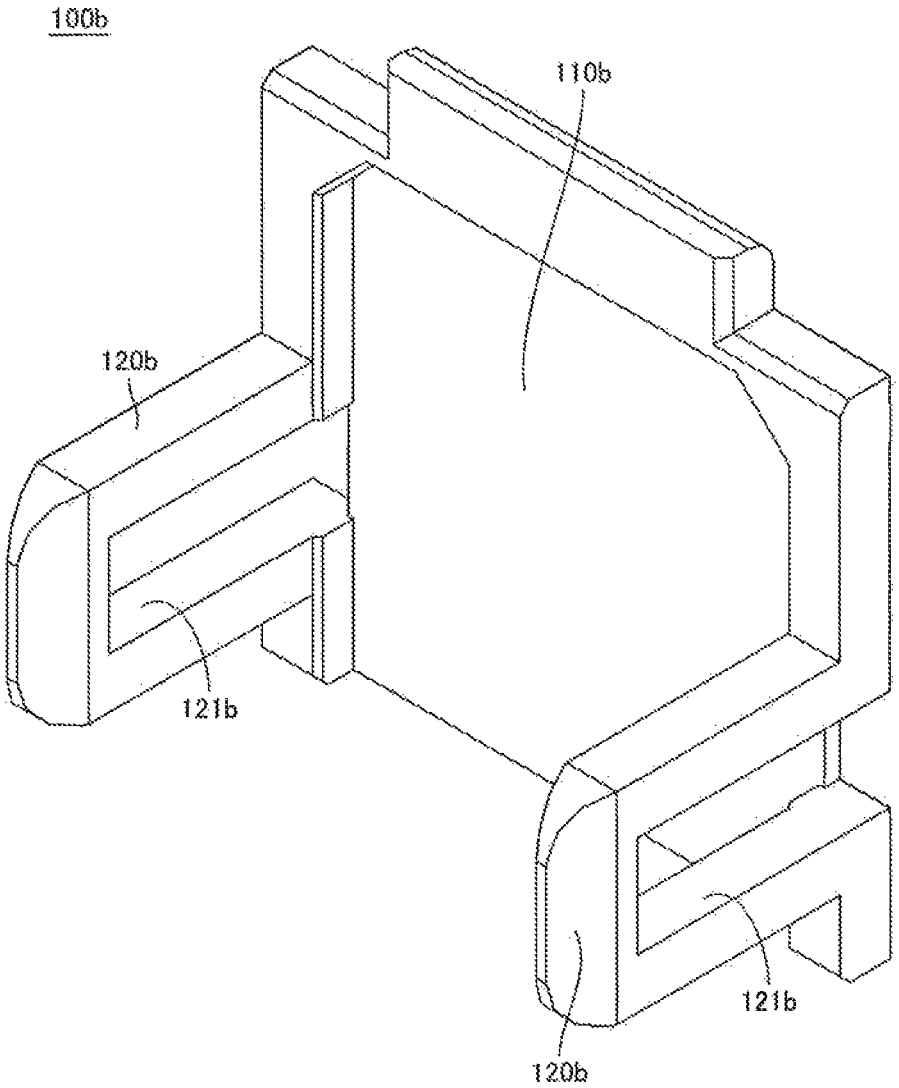
FIG. 5 is a schematic front, top, and right side perspective view of a cover of the connector.

As shown in FIG. 5, the cover 100*b* has a cover body 110*b* and a pair of locking arms 120*b*. The cover body 110*b* is a plate for covering the fourth face of the base 110*a* of the main body 100*a* and hanging portions 213*b*, 223*b*, 233*b*, 243*b*, and 253*b* (to be described) of the second terminal group T2 arranged along the fourth face (see FIG. 2C). The locking arms 120*b* extend in the second direction Y from the ends in the first direction X of the cover body 110*b*. The locking arms 120*b* are of generally U shapes and each have a locking hole 121*b*. The locking arms 120*b* are to be inserted into the locking recesses 111*a* of the main body 100*a* so as to lock the locking projections 112*a* in the locking holes 121*b*.

Figure 6A:
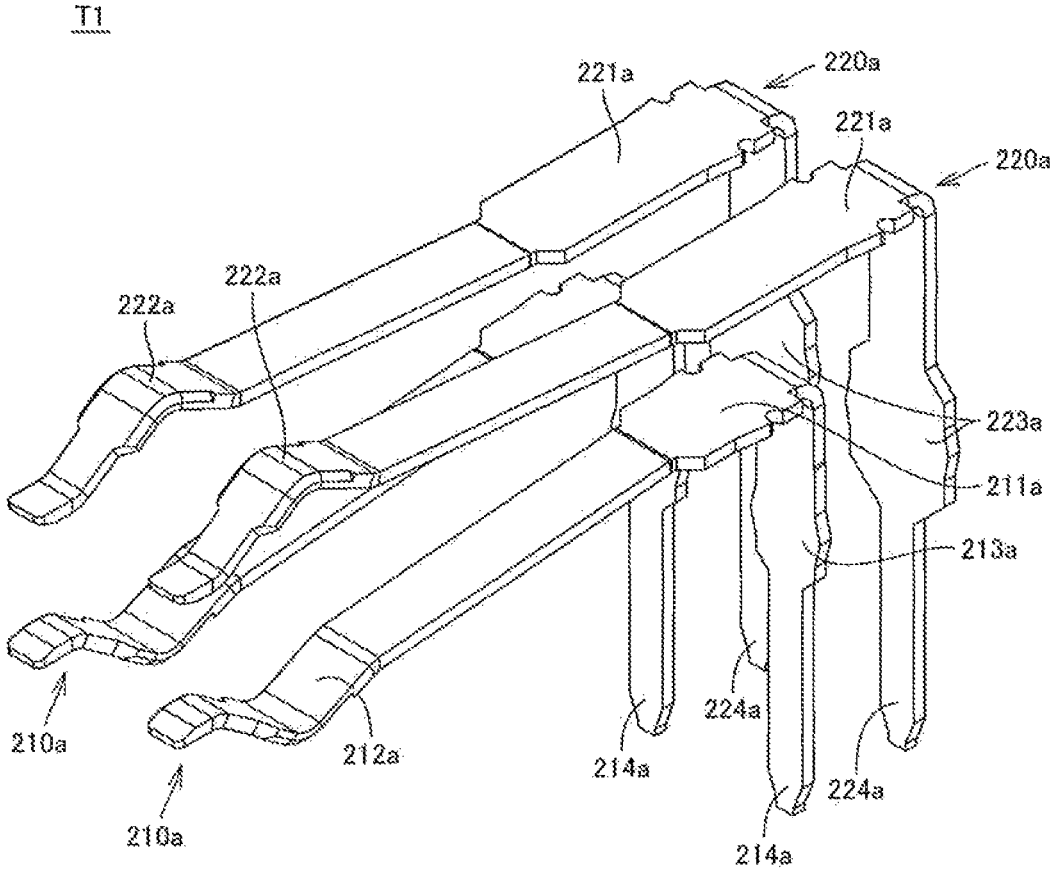
FIG. 6A is a schematic front, top, and right side perspective view of the first terminal group of the connector.
Figure 6B:
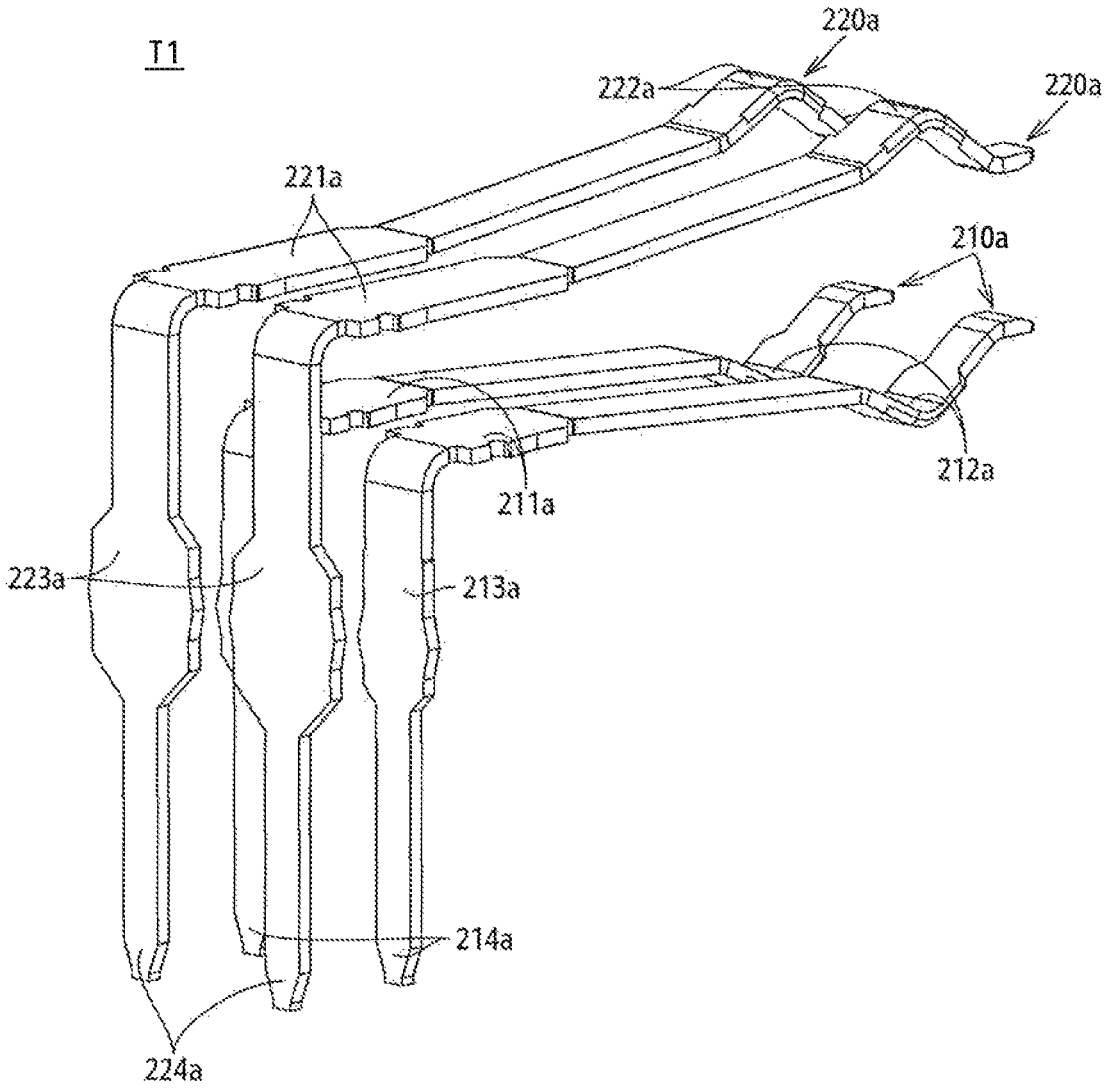
FIG. 6B is a schematic rear, top, and left side perspective view of the first group terminals of the connector.

As shown in FIGS. 6A and 6B, the first terminal group T1 has a pair of terminals 210*a* and a pair of terminals 220*a*. The terminals 210*a* are electrically conductive metal plates of generally upside-down L shapes. The terminals 220*a* also electrically conductive metal plates of generally upside-down L shapes, but they have larger outer dimensions than the terminals 210*a*. The terminals 210*a* are arrayed in a row with spacing along the first direction X inside the main body 100*a*. The terminals 220*a* are arrayed in a row above the terminals 210*a* with spacing along the first direction X inside the main body 100*a*.

Each of the terminals 210*a* has a retention portion 211*a*, a contact portion 212*a*, a hanging portion 213*a*, and a tail 214*a*. The retention portion 211*a* is a rectangular plate provided with locking pieces at ends in the first direction X. The retention portion 211*a* including the locking pieces has a slightly larger dimension in the first direction X than each first accommodating hole 115*a* in the main body 100*a*. Accordingly, the retention portion 211*a* is adapted to be pressed into the first accommodating hole 115*a* in the main body 100*a*. The contact portion 212*a* is a rectangular plate continuing to one end (a first end) in the second direction Y of the retention portion 211*a* so as to extend in the second direction Y and slope downward. A tip end of the contact portion 212*a* is provided with a downward-pointed V-shaped portion. The contact portion 212*a* is adapted to be accommodated in one of the first accommodating grooves 141*a* in the main body 100*a*. When the contact portion 212*a* is accommodated in the first accommodating groove 141*a*, its V-shaped portion may project downward from the first accommodating groove 141*a*.

The hanging portion 213*a* is a rectangular plate continuing to the other end (a second end) in the second direction Y of the retention portion 211*a* and bent substantially perpendicularly with respect to the retention portion 211*a* to extend in the third direction Z. The ends in the first direction X of the hanging portion 213*a* are provided with locking pieces. The hanging portion 213*a* including the locking pieces has a slightly larger dimension in the first direction X than each third accommodating recess 117*a* in the main body 100*a*. Accordingly, the hanging portion 213*a* is adapted to be pressed into the third accommodating recess 117*a* in the main body 100*a*. The tail 214*a* is a rectangular plate continuous with the hanging portion 213*a* to extend in the third direction Z. When the hanging portion 213*a* is pressed and held into the third accommodating recess 117*a* in the main body 100*a*, the tail 214*a* projects downward from the third accommodating recess 117*a*. The tail 214*a* as projected is connectable into a throughhole electrode of the circuit board.

Each of the terminals 220*a* includes a retention portion 221*a*, a contact portion 222*a*, a hanging portion 223*a*, and a tail 224*a*. The retention portion 221*a* is a rectangular plate provided with locking pieces at ends in the first direction X. The retention portion 221*a* including the locking pieces has a slightly larger dimension in the first direction X than each second accommodating hole 116*a* in the main body 100*a*. Accordingly, the retention portion 221*a* is adapted to be pressed into the second accommodating hole 116*a* in the main body 100*a*. The contact portion 222*a* is a rectangular plate continuing to one end (a first end) in the second direction Y of the retention portion 221*a* so as to extend in the second direction Y and slope upward. A tip end of the contact portion 222*a* is provided with a upward-pointed V-shaped portion. The contact portion 222*a* is adapted to be accommodated in one of the second accommodating grooves 142*a* in the main body 100*a*. When the contact portion 222*a* is accommodated in the second accommodating groove 142*a*, its V-shaped portion may project upward from the second accommodating groove 142*a*.

The hanging portion 223*a* is a rectangular plate continuing to the other end (a second end) in the second direction Y of the retention portion 221*a* and bent substantially perpendicularly with respect to the retention portion 221*a* to extend in the third direction Z. The ends in the first direction X of the hanging portion 223*a* are provided with locking pieces. The hanging portion 223*a* including the locking pieces has a slightly larger dimension in the first direction X than each third accommodating recess 117*a* in the main body 100*a*. Accordingly, the hanging portion 223*a* is adapted to be pressed into the third accommodating recess 117*a* in the main body 100*a*. The tail 224*a* is a rectangular plate continuous with the hanging portion 223*a* to extend in the third direction Z. When the hanging portion 223*a* is pressed and held into the third accommodating recess 117*a* in the main body 100*a*, the tail 224*a* projects downward from the third accommodating recess 117*a*. The projecting tail 224*a* as projected is connectable into a throughhole electrode of the circuit board.

Figure 7A:
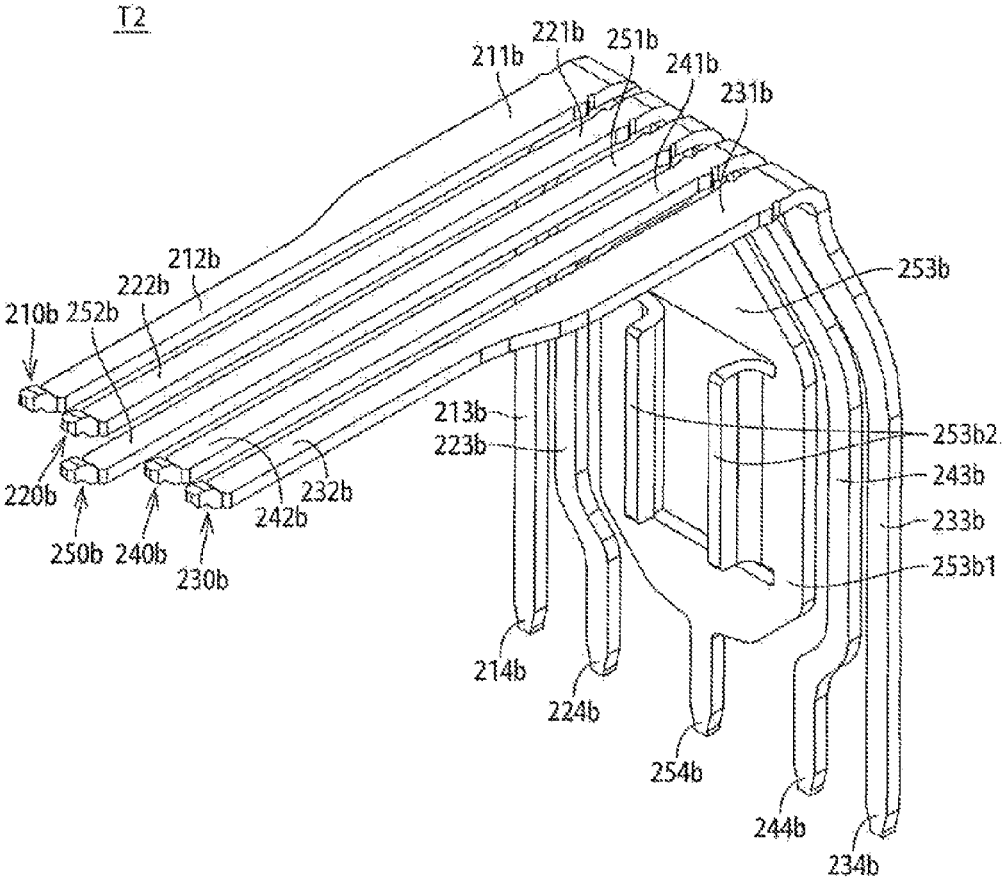
FIG. 7A is a schematic front, top, and right side perspective view of the second terminal group of the connector.
Figure 7B:
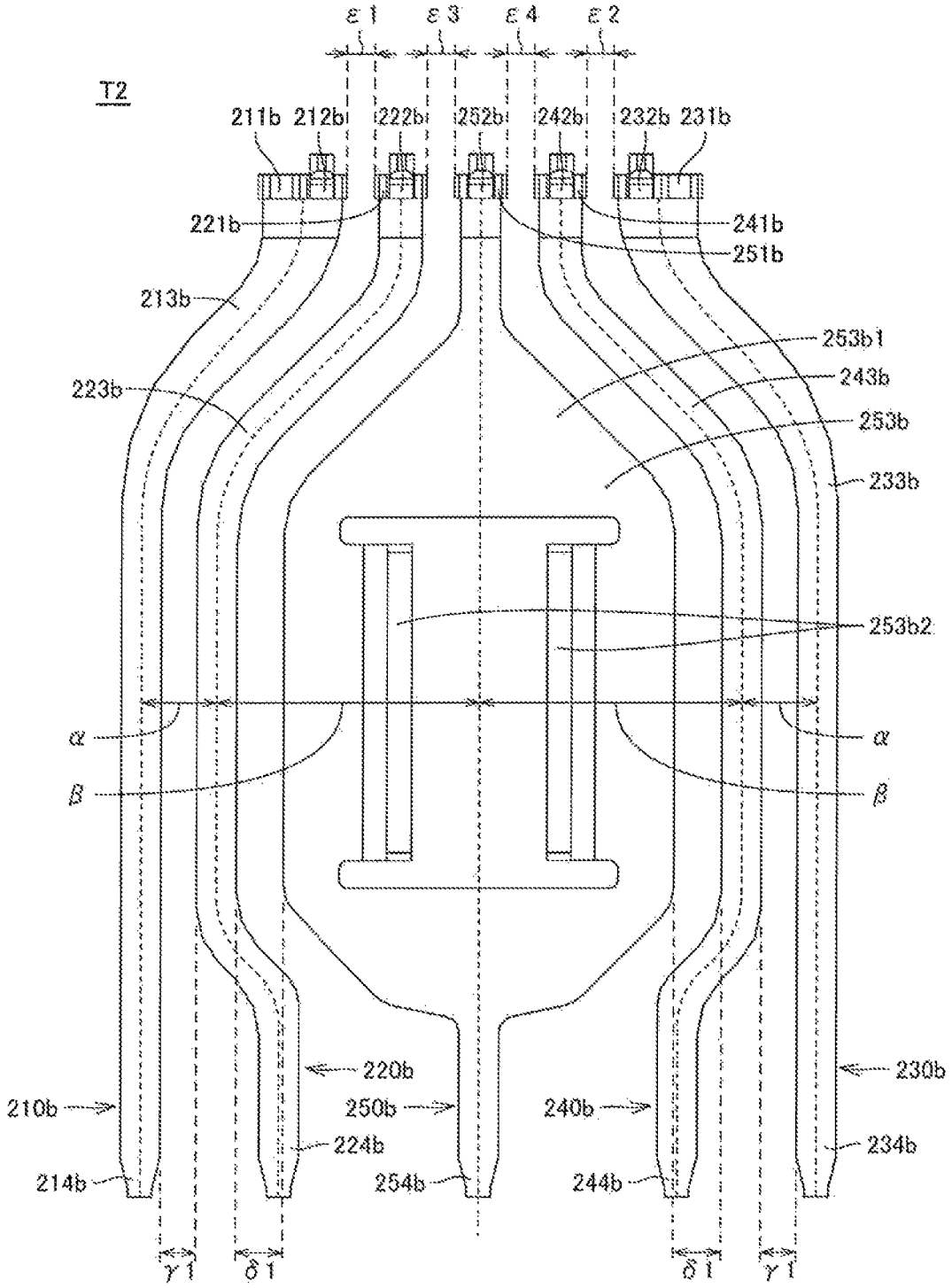
FIG. 7B is a schematic front view of the second terminal group of the connector.

As shown in FIGS. 7A and 7B, the second terminal group T2 includes a pair of differential signal terminals 210*b* and 220*b* (first signal terminals), a pair of differential signal terminals 230*b* and 240*b* (second signal terminals), and a ground terminal 250*b* (a third terminal). The terminals 210*b*, 220*b*, 230*b*, 240*b* and 250*b* are configured to be arrayed in a row along the first direction X in the main body 100*a*. The differential signal terminals 210*b* and 220*b* are electrically conductive metal plates of a generally upside-down L shape. They are disposed adjacent to each other in the first direction X and can transmit differential signals of several ten MHz to several GHz. The differential signal terminals 230*b* and 240*b* are electrically conductive metal plates of a generally upside-down L shape. They are disposed adjacent to each other in the first direction X and can transmit differential signals of several ten MHz to several GHz. The ground terminal 250*b* is a electrically conductive metal plate of a generally upside-down L shape. It is configured to be disposed between the differential signal terminal 220*b* and the differential signal terminal 240*b*.

The differential signal terminals 210*b* and 220*b* include retention portions 211*b* and 221*b*, contact portions 212*b* and 222*b*, hanging portions 213*b* and 223*b*, and tails 214*b* and 224*b*, respectively. The retention portion 211*b* is a generally rectangular plate provided with locking pieces at ends in the first direction X. The retention portion 211*b* including the locking pieces has a slightly larger dimension in the first direction X than the associated the third accommodating hole 118*a* in the main body 100*a*. Accordingly, the retention portion 211*b* is adapted to be pressed into the associated third accommodating hole 118*a*. The retention portion 221*b* has the same configuration as the retention portion 211*b*, except that the retention portion 221*b* has a smaller dimension in the first direction X than the retention portion 211*b*. Therefore, the retention portion 221*b* will not be described further in detail.

The contact portion 212*b* is a rectangular plate continuing to one end (a first end) in the second direction Y of the retention portion 211*b* so as to extend in the second direction Y. The dimension in the first direction X of the contact portion 212*b* is smaller than that of the retention portion 211*b* and slightly smaller than that of the associated third accommodating groove 151*a* in the main body 100*a*. A tip end of the contact portion 212*b* is provided with an abuttable portion sloping upward. The contact portion 212*b* can be accommodated in the associated third accommodating groove 151*a*. When the contact portion 212*b* is accommodated in the associated third accommodating groove 151*a*, the abuttable portion of the contact portion 212*b* is locked against the edge on one side in the second direction Y of the third accommodating groove 151*a*, and the lower face of the contact portion 212*b* is exposed downward from the third accommodating groove 151*a*. The contact portion 222*b* has the same configuration as the contact portion 212*b*, except that the contact portion 222*b* has the same dimension in the first direction X as the retention portion 221*b*. Therefore, the contact portion 222*b* will not be described further in detail.

The hanging portion 213*b* is a plate continuing to the other end (a second end) in the second direction Y of the retention portion 211*b* and bent substantially perpendicularly to the retention portion 211*b* so as to extend in the third direction Z. The end portion on one side in the third direction Z of the hanging portion 213*b* is curved to one side in the first direction X (left side in FIG. 7B) to form a curved portion to detour an extended portion 253*b*1 (to be described) of the ground terminal 250*b*. The hanging portion 223*b* is a plate continuing to the other end in the second direction Y of the retention portion 221*b* and bent substantially perpendicularly to the retention portion 221*b* so as to extend in the third direction Z. The end portions on one and the other sides in the third direction Z of the hanging portion 223*b* are curved to the one side in the first direction X (left side in FIG. 7B) to form curved portions to detour the extended portion 253*b*1 of the ground terminal 250*b*. The hanging portions 213*b* and 223*b* may extend along the fourth face of the main body 100*a* when the retention portions 211*b* and 221*b* are pressed and held into the third accommodating holes 118*a* (see FIGS. 2C and 3B).

The tails 214*b* and 224*b* are rectangular plates continuing to the hanging portions 213*b* and 214*b*, respectively, so as to extend straight in the third direction Z. The tails 214*b* and 224*b* project downward from the sixth face of the main body 100*a* when the retention portions 211*b* and 221*b* are pressed and held into the associated third accommodating holes 118*a*.

The tails 214*b* and 224*b* as projected are connectable to throughhole electrodes of the circuit board.

The differential signal terminal 230*b* has a symmetric configuration of the differential signal terminal 210*b*. The differential signal terminal 240*b* has a symmetric configuration of the differential signal terminal 220*b*. The differential signal terminals 230*b* and 240*b* have retention portions 231*b* and 241*b*, contact portions 232*b* and 242*b*, hanging portions 233*b* and 243*b*, and tails 234*b* and 244*b*, respectively. The end portion on one side in the third direction Z of the hanging portion 233*b* is curved to the other side in the first direction X (right side in FIG. 7B) to form a curved portion to detour the extended portion 253*b*1 of the ground terminal 250*b*. The end portions on one and the other sides in the third direction Z of the hanging portion 243*b* are curved to the other side in the first direction X (right side in FIG. 7B) to form curved portions to detour the extended portion 253*b*1 of the ground terminal 250*b*. The respective portions of the differential signal terminals 230*b* and 240*b* will not be described further in detail to avoid redundancies with the descriptions of the differential signal terminals 210*b* and 220*b*.

The ground terminal 250*b* includes a retention portion 251*b*, a contact portion 252*b*, a hanging portion 253*b*, and a tail 254*b*. The retention portion 251*b* and the contact portion 252*b* have the same configurations as the retention portion 221*b* and the contact portion 222*b*, respectively. The hanging portion 253*b* is a plate continuing to the other end (a second end) in the second direction Y of the retention portion 251*b* and bent substantially perpendicularly to the retention portion 251 so as to extend in the third direction Z. The hanging portion 253*b* has the extended portion 253*b*1 in a generally hexagonal shape extending in the first direction X. The extended portion 253*b*1 has a larger dimension in the first direction X than the remaining portions (the retention portion 251*b*, the contact portion 252*b*, and the tail 254*b*) of the ground terminal 250*b*. The extended portion 253*b*1 has a rectangular opening at its middle portion (corresponding to "a portion" of the third terminal in the claims). Edges in the first direction X of the opening, or the middle portion of the extended portion 253*b*1, are open like double doors oriented in the second direction Y to form a pair of shielding portions 253*b*2. In other words, the shielding portions 253*b*2 are cut-raised sections made by cutting and raising the middle portion of the extended portion 253*b*1 at a right angle so as to extend in the second direction Y (the direction perpendicular to the first direction X). The shielding portion 253*b*2 are adapted to be inserted into the first accommodating recess 113*a*, the second accommodating recess 114*a*, and the third accommodating recess 117*a* in the main body 100*a* when the retention portion 251*b* is pressed and held into the associated third accommodating hole 118*a* in the main body 100*a* (see FIGS. 2A and 2C).

FIG. 7B illustrates dashed lines to indicate virtual centerlines of the differential signal terminals 210*b* and 220*b*, the differential signal terminals 230*b* and 240*b*, and the ground terminal 250*b*. The sign α indicates the distance in the first direction X between the centerlines of the hanging portions 213*b* and 223*b* of the differential signal terminals 210*b* and 220*b* and also between the centerlines of the hanging portions 233*b* and 243*b* of the differential signal terminals 230*b* and 240*b*. The sign β indicates the distance in the first direction X between the centerline of the extended portion 253*b*1 of the hanging portion 253*b* of the ground terminal 250*b* and the centerline of the hanging portion 223*b* of the differential signal terminal 220*b* and also between the centerline of the extended portion 253*b*1 of the hanging portion 253*b* of the ground terminal 250*b* and the centerline of the hanging portion 243*b* of the differential signal terminal 240*b*. The distances α and β are set to satisfy a relational expression "β>α". Accordingly, it is possible to increase the dimension in the first direction X of the extended portion 253*b*1. As the shielding portions 253*b*2 are cut-raised sections made by made by cutting and raising the middle portion of the extended portion 253*b*1, it is possible to obtain the shielding portions 253*b*2 of a large height dimension (the dimension in the second direction Y) from the extended portion 253*b*1. The height dimension of each shielding portion 253*b*2 is preferably twice the plate thickness of the ground terminal 250*b* or larger.

In FIG. 7B, the sign γ1 indicates the distance in the first direction X between the hanging portions 213*b* and 223*b* of the differential signal terminals 210*b* and 220*b* and also between the hanging portions 233*b* and 243*b* of the differential signal terminals 230*b* and 240*b*. The sign δ1 indicates the distance in the first direction X between the hanging portion 253*b* of the ground terminal 250*b* and the hanging portion 223*b* of the differential signal terminal 220*b* and also between the hanging portion 253*b* of the ground terminal 250*b* and the hanging portion 243*b* of the differential signal terminal 240*b*. The distances δ1 and γ1 are set to satisfy a relational expression "δ1>γ1". This configuration can lessen the possibility of electromagnetic waves (electromagnetic field energy) radiated at an angle to the first direction X from the hanging portion 223*b* of the differential signal terminal 220*b* interfering with the hanging portion 243*b* of the differential signal terminal 240*b*. This configuration can also lessen the possibility of electromagnetic waves (electromagnetic field energy) radiated at an angle to the first direction X from the hanging portion 243*b* of the differential signal terminal 240*b* interfering with the hanging portion 223*b* of the differential signal terminal 220*b*.

In FIG. 7B, the sign ϵ1 indicates the distance in the first direction X between the retention portion 211*b* of the differential signal terminal 210*b* and the retention portion 221*b* of the differential signal terminal 220*b* and also between the contact portion 212*b* of the differential signal terminal 210*b* and the contact portion 222*b* of the differential signal terminal 220*b*. The sign ϵ2 indicates the distance in the first direction X between the retention portion 231*b* of the differential signal terminal 230*b* and the retention portion 241*b* of the differential signal terminal 240*b* and also between the contact portion 232*b* of the differential signal terminal 230*b* and the contact portion 242*b* of the differential signal terminal 240*b*. The sign ϵ3 indicates the distance in the first direction X between the retention portion 251*b* of the ground terminal 250*b* and the retention portion 221*b* of the differential signal terminal 220*b* and also between the contact portion 252*b* of the ground terminal 250*b* and the contact portion 222*b* of the differential signal terminal 220*b*. The sign ϵ4 indicates the distance in the first direction X between the retention portion 251*b* of the ground terminal 250*b* and the retention portion 241*b* of the differential signal terminal 240*b* and also between the contact portion 252*b* of the ground terminal 250*b* and the contact portion 242*b* of the differential signal terminal 240*b*. The distances ϵ1, ϵ2, ϵ3, and ϵ4 are set to satisfy a relational expression "ϵ1=ϵ2=ϵ3=ϵ4".

The tail 254*b* is a rectangular plate continuing to the hanging portion 253*b* so as to extend straight in the third direction Z. The tail 254*b* projects downward from the sixth face of the main body 100*a* when the retention portion 251*b* is pressed and held into the associated third accommodating hole 118*a*. The tail 254*b* as projected is connectable to an associated throughhole electrode on the circuit board and further to the ground.

Figure 8A:
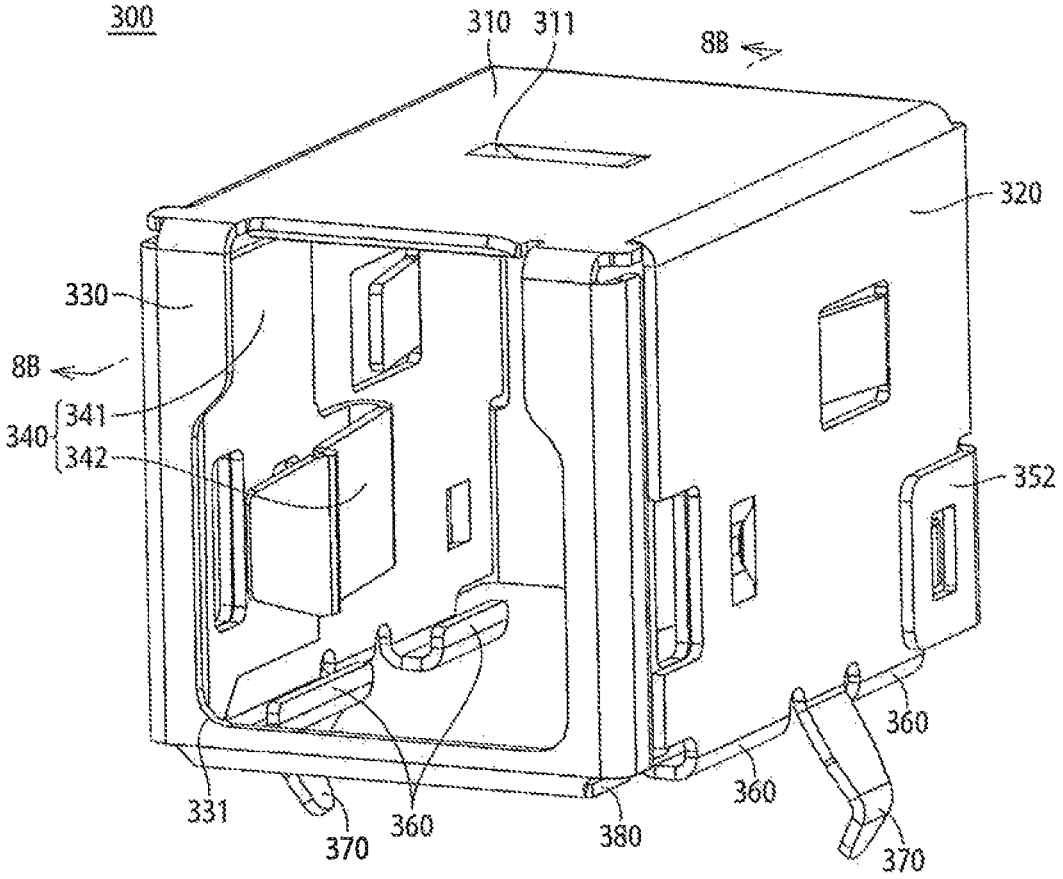
FIG. 8A is a schematic front, top, and right side perspective view of a shield case of the connector.
Figure 8B:
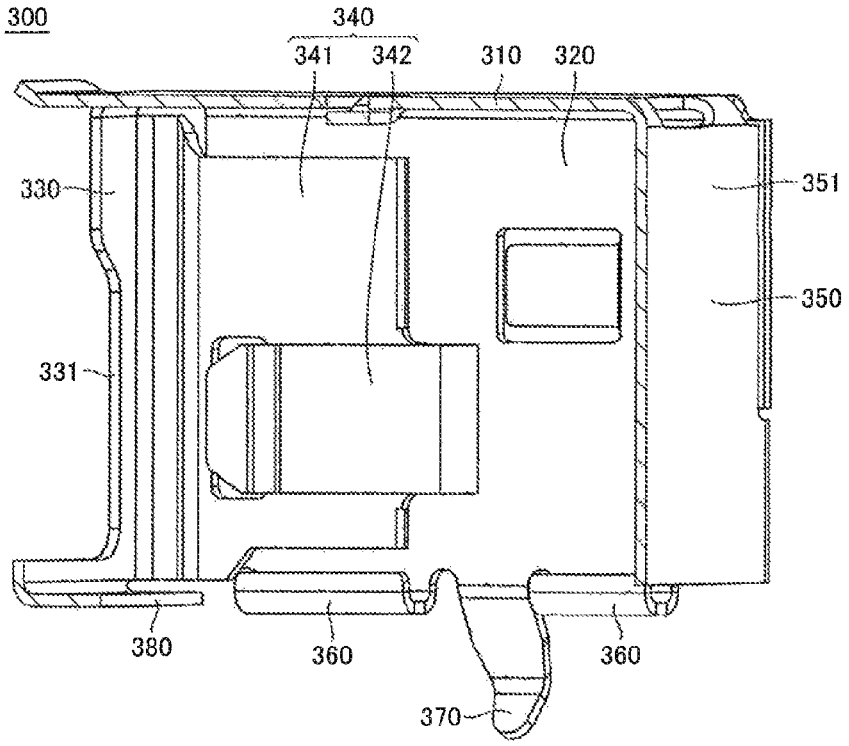
FIG. 8B is a perspective view of a cross section of the shield case of the connector, taken along line 8B-8B in FIG. 8A.

As shown in FIGS. 8A and 8B, the shield case 300 is a square box made of a conductive metal plate for accommodating the body 100. The shield case 300 includes a top plate 310, a pair of side plates 320, a front plate 330, a pair of extended plates 340, a rear plate 350, four locking pieces 360, a pair of locking legs 370, and a supporting plate 380.

The top plate 310 is a rectangular plate adapted to abut the fifth face of the base 110*a* of the main body 100*a* (see FIGS. 2A and 2B). The top plate 310 is provided at the center with a projection 311 projecting downward for abutment with the third face of the base 110*a*. The side plates 320 are rectangular plates provided at ends in the first direction X of the top plate 310 and bent perpendicularly to the top plate 310. The side plates 320 are abuttable on the first and second faces of the base 110*a* and the locking arms 120*b* of the cover 100*b* locked against the base 110*a* (see FIG. 2C).

The front plate 330 is a rectangular plate provided at one end in the second direction Y of the top plate 310 and bent perpendicularly to the top plate 310. The front plate 330 has an opening 331 for exposing the connecting hole 160*a* in the body 100. The rear plate 350 has a rear plate body 351 and a pair of tabs 352. The rear plate body 351 is a rectangular plate provided at the other end in the second direction Y of the top plate 310 and bent perpendicularly to the top plate 310. The rear plate body 351 can cover the cover body 110*b* of the cover 100*b*. The tabs 352 are provided at ends in the first direction X of the rear plate body 351 and bent perpendicularly to the rear plate body 351. The tabs 352 are in abutment and engagement with the outer faces of the side plates 320.

The extended plates 340 each have a locking plate 341 and a holding arm 342. The locking plates 341 are rectangular plates provided at ends in the first direction X of the front plate 330 and bent perpendicularly to the front plate 330. The holding arms 342 are provided at the respective other ends in the second direction Y of the locking plates 341 and folded back inward in the first direction X. The locking plates 341 are in abutment and engagement with the inner faces of the side plates 320. The holding arms 342 are received in the connecting hole 160*a* of the body 100 through the lateral holes 121*a* when the body 100 is accommodated in the shield case 300. The distance in the first direction X between the holding arms 342 is smaller than the dimension in the first direction X of the plug connector. Accordingly, the holding arms 342 are resiliently abuttable on the plug connector as received in the connecting hole 160*a* in the main body 100*a*.

The four locking pieces 360 are arranged, in pairs with spacing in the second direction Y, at the respective lower ends of the side plates 320. The locking pieces 360 are curved inward in a generally U shape. The tip ends of the locking pieces 360 are adapted to be locked in the engaging grooves 170*a* in the main body 100*a*. The locking legs 370 are each provided between the paired locking pieces 360 at the lower end of the associated side plate 320. The locking legs 370 are to be received in locking holes in the circuit board for ground connection. The supporting plate 380 is a rectangular plate provided at the end on the other side in the third direction Z of the front plate 330 and bent perpendicularly to the front plate 330. The supporting plate 380 is abuttable on the bottom wall 130*a* of the main body 100*a*.

The receptacle connector as described above may be assembled in the following steps. The first step is to prepare the main body 100*a* by injection molding an insulating resin. Also prepared are the terminals 210*a* by press molding an electrically conductive metal plate. Thereafter, the contact portions 212*a* and the retention portions 211*a* of the terminals 210*a* are inserted into the respective first accommodating holes 115*a* in the main body 100*a*. At this time, the retention portions 211*a* of the terminals 210*a* are pressed and held into the first accommodating holes 115*a* in the main body 100*a*; the contact portions 212*a* of the terminals 210*a* are accommodated in the respective first accommodating grooves 141*a* in the main body 100*a*; the V-shaped portions of the contact portions 212*a* project downward from the respective first accommodating grooves 141*a*; the hanging portions 213*a* of the terminals 210*a* are pressed and held into the respective third accommodating recesses 117*a* in the main body 100*a*; and the tails 214*a* project downward from the respective third accommodating recesses 117*a* in the main body 100*a*. As a result, the two terminals 210*a* are arrayed in a row along the main body 100*a*.

The next step is to prepare the terminals 220*a* by press molding an electrically conductive metal plate. Thereafter, the contact portions 222*a* and the retention portions 221*a* of the terminals 220*a* are inserted into the respective second accommodating holes 116*a* in the main body 100*a*. At this time, the retention portions 221*a* of the terminals 220*a* are pressed and held into the respective second accommodating holes 116*a* in the main body 100*a*; the contact portions 222*a* of the terminals 220*a* are accommodated in the respective second accommodating grooves 142*a* in the main body 100*a*; the V-shaped portions of the contact portions 222*a* project upward from the respective second accommodating grooves 142*a*; the hanging portions 223*a* of the terminals 220*a* are pressed and held into the respective third accommodating recesses 117*a* in the main body 100*a* so as to be disposed behind the hanging portions 213*a*; and the tails 224*a* project downward from the respective third accommodating recesses 117*a* in the main body 100*a*. As a result, the two terminals 220*a* are arrayed in a row in the main body 100*a* above the terminals 210*a*.

The next step is to prepare the differential signal terminals 210*b* and 220*b*, the differential signal terminals 230*b* and 240*b*, and the ground terminal 250*b* formed by press molding an electrically conductive metal plate. Then the contact portion 212*b* and the retention portion 211*b* of the differential signal terminal 210*b* are inserted into the associated one of the third accommodating holes 118*a* in the main body 100*a*. At this time, the retention portion 211*b* of the differential signal terminal 210*b* is pressed and held into the third accommodating hole 118*a* in the main body 100*a*; the contact portion 212*b* of the differential signal terminal 210*b* is accommodated in the associated one of the third accommodating grooves 151*a* in the main body 100*a*, the abuttable portion of the contact portion 212*b* is locked against the edge on the one side in the second direction Y of the third accommodating groove 151*a*, and the lower face of the contact portion 212*b* is exposed downward from the third accommodating groove 151*a*; the hanging portion 213*b* of the differential signal terminal 210*b* is disposed along the fourth face of the main body 100*a*; and the tail 214*b* projects downward from the sixth face of the main body 100*a*. Likewise, the differential signal terminal 220*b* and the differential signal terminals 230*b* and 240*b* are attached into the main body 100*a*.

Thereafter, the contact portion 252*b* and the retention portion 251*b* of the ground terminal 250*b* are inserted into the associated one of the third accommodating holes 118*a* in the main body 100*a*. At this time, the retention portion 251*b* of the ground terminal 250*b* is pressed and held into the third accommodating hole 118*a* in the main body 100*a*; the contact portion 252*b* of the ground terminal 250*b* is accommodated in the associated one of the third accommodating grooves 151*a* in the main body 100*a*, the abuttable portion of the contact portion 252*b* is locked against the edge on the one side in the second direction Y of the third accommodating groove 151*a*, and the lower face of the contact portion 252*b* is exposed downward from the third accommodating groove 151*a*; the hanging portion 253*b* of the ground terminal 250*b* is disposed along the fourth face of the main body 100*a*; the shielding portions 253*b*2 of the hanging portion 253*b* are inserted into the first accommodating recess 113*a*, the second accommodating recess 114*a*, and the respective third accommodating recesses 117*a* in the main body 100*a*; and the tail portion 254*b* projects downward from the sixth face of the main body 100*a*. It is to be noted that the differential signal terminals 210*b* and 220*b*, the differential signal terminals 230*b* and 240*b*, and the ground terminal 250*b* may be attached to the main body 100*a* in the above order, in any other order, or all at the same time.

After all the terminals are attached into the body 100*a*, the cover 100*b* is prepared by injection molding an insulating resin. Thereafter, the locking arms 120*b* of the cover 100*b* are inserted into the respective locking recesses 111*a* in the main body 100*a*, and the locking projections 112*a* of the main body 100*a* are locked in the locking holes 121*b* in the locking arms 120*b*. Then, the cover body 110*b* of the cover 100*b* covers the fourth face of the base 110*a* of the main body 100*a* and the hanging portions 213*b*, 223*b*, 233*b*, 243*b*, and 253*b*. The cover 100*b* is thus attached to the main body 100*a* to provide the body 100.

The next step is to prepare the shield case 300 by press molding an electrically conductive metal plate. In the shield case 300 as molded, the rear plate body 351 of the rear plate 350 is not bent to the top plate 310, or the tabs 352 are not bent. Then the body 100 is inserted into the shield case 300 from the rear side. At this time, the tip ends of the locking pieces 360 of the shield case 300 are inserted and guided into the engaging grooves 170*a* in the body 100. Thereafter, the projection 311 on the shield case 300 is brought into abutment with the third face of the base 110*a* of the body 100. The connecting hole 160*a* in the body 100 now communicate with the opening 331 in the shield case 300. Simultaneously, the holding arms 342 of the shield case 300 are inserted from the lateral holes 121*a* in the body 100 into the connecting hole 160*a* in the body 100.

Thereafter, the rear plate body 351 of the rear plate 350 is bent perpendicularly to the top plate 310. The bent rear plate body 351 abuts and covers the cover 100*b* of the body 100. Thereafter, the tabs 352 are bent perpendicularly to the rear plate body 351 and brought into engagement with the side plates 320. The above are the exemplary assembly steps of the receptacle connector.

The receptacle connector described above have many advantageous features. First, the shielding portions 253*b*2 of the extended portion 253*b*1 of the ground terminal 250*b* extend in the second direction Y. The shielding portions 253*b*2 can shield electromagnetic waves (electromagnetic field energy) radiated at an angle to the first direction X from the hanging portions 213*b* and 223*b* of the differential signal terminals 210*b* and 220*b* or the hanging portions 233*b* and 243*b* of the differential signal terminals 230*b* and 240*b*. Therefore, the connector is advantageous in reducing crosstalk between the differential signal terminal 220*b* and the differential signal terminal 240*b* that are adjacent to each other with the ground terminal 250*b* interposed therebetween, and/or between the signal terminals 210*b* and 220*b* and the differential signal terminals 230*b* and 240*b* (i.e. between differential pairs).

In addition, the differential signal terminals 210*b* and 220*b*, the differential signal terminals 230*b* and 240*b*, and the ground terminal 250*b* are arranged to satisfy the relation "$\beta>\alpha$". Further, the end portion on the one side in the third direction Z of the hanging portion 213*b* is curved to the one side in the first direction X, and the end portions on the one and other sides in the third direction Z of the hanging portion 223*b* are curved to the one side in the first direction X. The end portion on the one side in the third direction Z of the hanging portion 233*b* is curved to the other side in the first direction X, and the end portions on the one and other sides in the third direction Z of the hanging portion 243*b* are curved to the other side in the first direction X. Such configuration of the terminals makes it possible to increase the dimension in the first direction X of the extended portion 253*b*1. The shielding portions 253*b*2 are cut-raised sections made by cutting and raising the middle portion of the extended portion 253*b*1, so that the extended portion 253*b*1 of a large dimension in the first direction X can provide the shielding portions 253*b*2 of large height dimensions. The shielding portions 253*b*2 of large height dimensions have improved efficiency in shielding the electromagnetic waves (electromagnetic field energy), making it possible to further reduce crosstalk. In addition, the relation "$\beta>\alpha$" allows to fabricate the differential signal terminals 210*b* and 220*b*, the differential signal terminals 230*b* and 240*b*, and the ground terminal 250*b* at a time by press molding a single metal plate. Consequently, the connector can be manufactured with a reduced cost.

The connector is not limited to the configurations according to the above embodiment and may be modified in design in any manner within the scope of claims. Exemplary modifications will be described in detail below.

The connector may have the first terminal group T1 and the second terminal group T2 as in Embodiment 1. However, the invention only requires the second terminal group as described above (see the next paragraph).

In Embodiment 1, the second terminal group T2 includes the pair of differential signal terminals 210*b* and 220*b*, the pair of differential signal terminals 230*b* and 240*b*, and the ground terminal 250*b* (the third terminal), which are adapted to be arrayed in a row along the first direction X. However, the second terminal group may be modified as long as it has at least the pair of first signal terminals, the pair of second signal terminals, and the third terminal, which are adapted to be arrayed in a row along the first direction.

The first signal terminals of the invention may be the pair of differential signal terminals of a generally upside-down L shape as in Embodiment 1, but they may be modified as long as they are adjacent to each other in the first direction. For instance, the first signal terminals may be terminals for transmission of signals other than differential signals. In addition, the first signal terminals may be rectilinear metal plates. The second signal terminals of the invention are not limited to the pair of differential signal terminals of a generally upside-down L shape as in Embodiment 1. For instance, the second signal terminals may be terminals for single-ended signaling. That is, at least one second signal terminal should be provided. In addition, the second signal terminals may be rectilinear metal plates.

In Embodiment 1, the third terminal is the ground terminal 250*b* of a generally upside-down L shape to be disposed between the differential signal terminals 220*b* and 240*b*. However, the third terminal of the invention may be modified as long as it is adapted to be disposed between one of a pair of first signal terminals and a second signal terminal and has a shielding portion extending in a direction crossing the first direction. For instance, the third terminal may be a power terminal or the like disposed between differential signal terminals and function as a pseudo ground terminal. The third terminal may be a rectilinear metal plate.

The retention portions 211*b* to 251*b* according to Embodiment 1 are rectangular plates to be pressed into the third accommodating holes 118*a* in the body 100. However, the retention portions of the first and second signal terminals and the third terminal may be modified in any manner as long as they extend in the second direction and are adapted to be held in the body (see paragraph 0079). The contact portions 212*b* to 252*b* according to Embodiment 1 are rectangular plates continuing to the associated one ends in the second direction Y of the retention portions 211*b* to 251*b* so as to extend in the second direction Y and be accommodated in the third accommodating grooves 151*a*. However, the contact portions of the first and second signal terminals and the third terminal may be modified in any manner as long as they extend in the second direction from the associated first ends in the second direction of the retention portions.

The hanging portions 213*b* to 253*b* according to Embodiment 1 are plates continuing to the associated other ends in the second direction Y of the retention portions 211*b* to 251*b* and bent substantially perpendicularly to the retention portions 211*b* to 251*b* so as to extend in the third direction Z. However, the hanging portions of the first and second signal terminals and the third terminal may be modified in any manner as long as they extend in the third direction from the associated second ends in the second direction of the retention portions. The tails 214*a* to 254*a* according to Embodiment 1 are rectangular plates continuing to the hanging portions 213*b* to 253*b* and rectilinearly extend in the third direction Z to be connected to the throughhole electrodes in the circuit board. However, the tails of the first and second signal terminals and the third terminal may be modified in any manner as long as they continue to the associated hanging portions. For instance, the tails may be bent substantially perpendicularly to the hanging portions and connectable to the electrodes provided on a surface of the circuit board.

The shielding portions 253*b*2 according to Embodiment 1 are cut-raised sections that are opposite edges of an opening formed by cutting and raising the middle portion of the extended portion 253*b*1 of the hanging portion 253*b* of the ground terminal 250*b*. However, the shielding portions may be modified in any manner as long as they are a portion of the third terminal and extend in a direction crossing the first direction that is the arraying direction of the second terminal group.

Figure 9A:
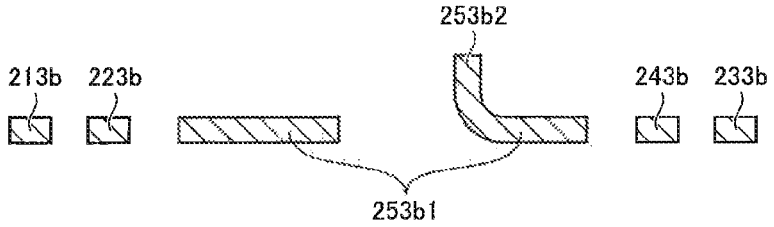
FIG. 9A is a schematic sectional view showing a first modification example of a shielding portion of a ground terminal of the second terminal group.
Figure 9B:
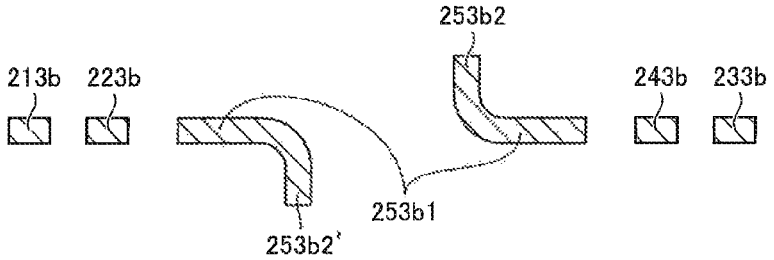
FIG. 9B is a schematic sectional view showing a second modification example of the shielding portion.

For instance, as shown in FIG. 9A, of the opposite edges of an opening formed by cutting the middle portion of the extended portion 253*b*1, only one of the edges may be raised to form a cut-raised section serving as a shielding portion 253*b*2. Alternatively, as shown in FIG. 9B, of the opposite edges of an opening formed by cutting the middle portion of the extended portion 253*b*1, one of the edges may be raised to one side in the second direction Y to form a cut-raised section serving as a shielding portion 253*b*2 and the other edge may be raised to the other side in the second direction Y to form a cut-raised section serving as a shielding portion 253*b*2'.

Figure 10A:
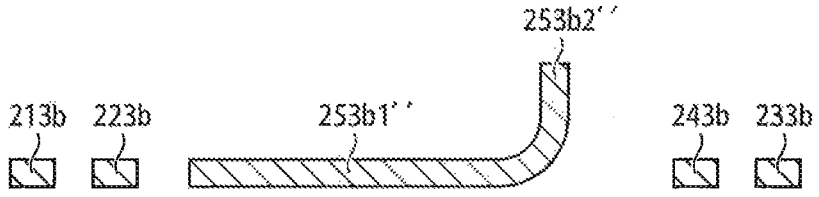
FIG. 10A is a schematic sectional view showing a third modification example of the shielding portion.
Figure 10B:
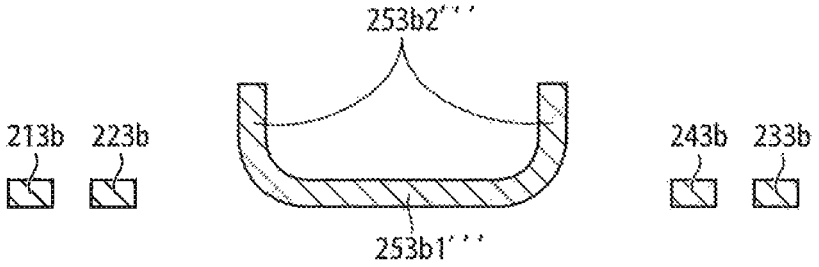
FIG. 10B is a schematic sectional view showing a fourth modification example of the shielding portion.
Figure 10C:
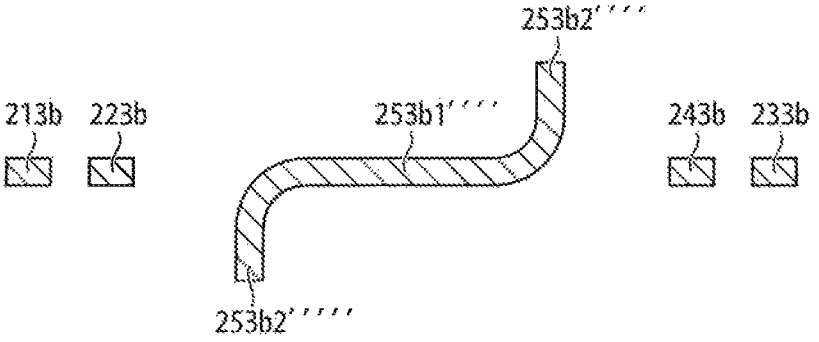
FIG. 10C is a schematic sectional view showing a fifth modification example of the shielding portion.

FIG. 10A illustrates another modified shielding portion 253*b*2", which is a bent section continuing to one end in the first direction X of an extended portion 253*b*1" and extending in the second direction. FIG. 10B illustrates modified shielding portions 253*b*2'", which are bent sections continuing to ends in the first direction X of an extended portion 253*b*1" and extending in the second direction. FIG. 10C illustrates modified shielding portions 253*b*2"" and 253*b*2""", which are also bent sections continuing to ends in the first direction X of an extended portion 253*b*1"". The shielding portion 253*b*2"" is bent to one side in the second direction Y, and the shielding portion 253*b*2""" is bent to the other side in the second direction Y.

Alternatively, if the first and second signal terminals and the third terminal have large dimensions in the first direction, the shielding portion may be any portion, not the extended portion, of the third terminal, that is cut-and-raised or bent. Alternatively, the shielding portion may be separately formed and attached to the third terminal by soldering, welding or any other means. Further, the shielding portion may be provided at the retention portion and the hanging portion, or it may be provided only at the retention portion. If the shielding portion is provided in the retention portion, the shielding portion may extend in the third direction crossing the first direction. The height dimension of the shielding portion may be twice the plate thickness of the ground terminal, larger than twice, or smaller than twice.

The extended portion 253*b*1 according to Embodiment 1 is provided in the hanging portion 253*b*. However, the extended portion may be omitted. In addition, the extended portion of the invention may be modified as long as it extends in the first direction and includes a portion of the third terminal that is adapted to be provided with the shielding portion.

In Embodiment 1, the distance $\beta$ is larger than the distance $\alpha$, where $\beta$ is the distance in the first direction X between the centerline of the extended portion 253*b*1 of the hanging portion 253*b* of the ground terminal 250*b* and the centerline of the hanging portion 223*b* of the differential signal terminal 220*b* and also between the centerline of the extended portion 253*b*1 of the hanging portion 253*b* of the ground terminal 250*b* and the centerline of the hanging portion 243*b* of the differential signal terminal 240*b*, and $\alpha$ is the distance in the first direction X between the centerlines of the hanging portions 213*b* and 223*b* of the differential signal terminals 210*b* and 220*b* and also between the centerlines of the hanging portions 233*b* and 243*b* of the differential signal terminals 230*b* and 240*b*. However, this distance relation may be modified.

For instance, the distance relation may be modified to "$\beta=\alpha$" or "$\beta<\alpha$" if the third terminal does not have the extended portion as discussed above, or if the first and second signal terminals and the third terminal are made by press molding individual metal plates.

It should be noted that $\beta$ may be modified to any distance in the first direction between the centerline of a portion of the third terminal and the centerline of a portion of each of the first and second signal terminals adjacent to the portion of the third terminal. Also, $\alpha$ may be modified to any distance in the first direction between the centerlines of the portions of the first signal terminals. For instance, if the portion of the third terminal is the retention portion, the distance $\beta$ in the first direction between the centerline of the retention portion and the centerline of each retention portion of the first and second signal terminals may be set to be larger than the distance $\alpha$ in the first direction between the centerlines of the retention portions of the first signal terminals.

The invention is not limited to the configurations of Embodiment 1, wherein the end portion on the one side in the third direction Z of the hanging portion 213*b* is curved to one side in the first direction X, the end portions on one and the other sides in the third direction Z of the hanging portion 223*b* are curved to the one side in the first direction X, the end portion on one side in the third direction Z of the hanging portion 233*b* is curved to the other side in the first direction X, and the end portions on one and the other sides in the third direction Z of the hanging portion 243*b* are curved to the other side in the first direction X.

For instance, the first and second signal terminals may not be curved if the third terminal does not have the extended portion as discussed above, or if the first and second signal terminals and the third terminal are made by press molding individual metal plates. Alternatively, in accordance with which portion of the third terminal serves as the shielding portion, portions other than the hanging portions of the first and second signal terminals may be curved in the first direction to detour the shielding portion of the third terminal.

The invention is not limited to the configurations of Embodiment 1, wherein the distance δ1 is larger than the distance γ1, where δ1 is the distance in the first direction X between the hanging portion 253*b* of the ground terminal 250*b* and the hanging portion 223*b* of the differential signal terminal 220*b* and also between the hanging portion 253*b* of the ground terminal 250*b* and the hanging portion 243*b* of the differential signal terminal 240*b*, and γ1 is the distance in the first direction X between the hanging portions 213*b* and 223*b* of the differential signal terminals 210*b* and 220*b* and also between the hanging portions 233*b* and 243*b* of the differential signal terminals 230*b* and 240*b*. In place of the relation "δ1>γ1," the invention will do with the relation "δ2>γ2," where δ2 is the distance in the first direction X between the retention portion 251*b* of the ground terminal 250*b* and the retention portion 221*b* of the differential signal terminal 220*b* and also between the retention portion 251*b* of the ground terminal 250*b* and the retention portion 241*b* of the differential signal terminal 240*b*, and γ2 is the distance between the retention portions 211*b* and 221*b* of the differential signal terminals 210*b* and 220*b* and also between the retention portions 231*b* and 241*b* of the differential signal terminals 230*b* and 240*b*. Alternatively, both the relations "δ1>γ1" and "δ2>γ2" may hold true in the invention.

The body 100 according to Embodiment 1 includes the main body 100*a* and the cover 100*b*. However, the body of the invention may be modified in any manner as long as it is configured to allow the array in a row of the pair of first signal terminals, the second signal terminal, and the third terminal. For instance, the pair of first signal terminals, the second signal terminal, and the third terminal may be insert-molded into the body to be arrayed in a row.

The shield case 300 according to Embodiment 1 is a square box made of an electrically conductive metal plate adapted to accommodate the body 100. However, the shield case may have any other configuration adapted to accommodate the body.

It should be noted that the materials, the shapes, the dimensions, the numbers, and the arrangements of the components of the connector according to Embodiment 1 is described above by way of example only. The connector may be modified in any manner as long as it can perform the same or similar functions. The connector of the invention may be a receptacle connector as in Embodiment 1, but it is applicable to a plug connector.

Figure 11A:
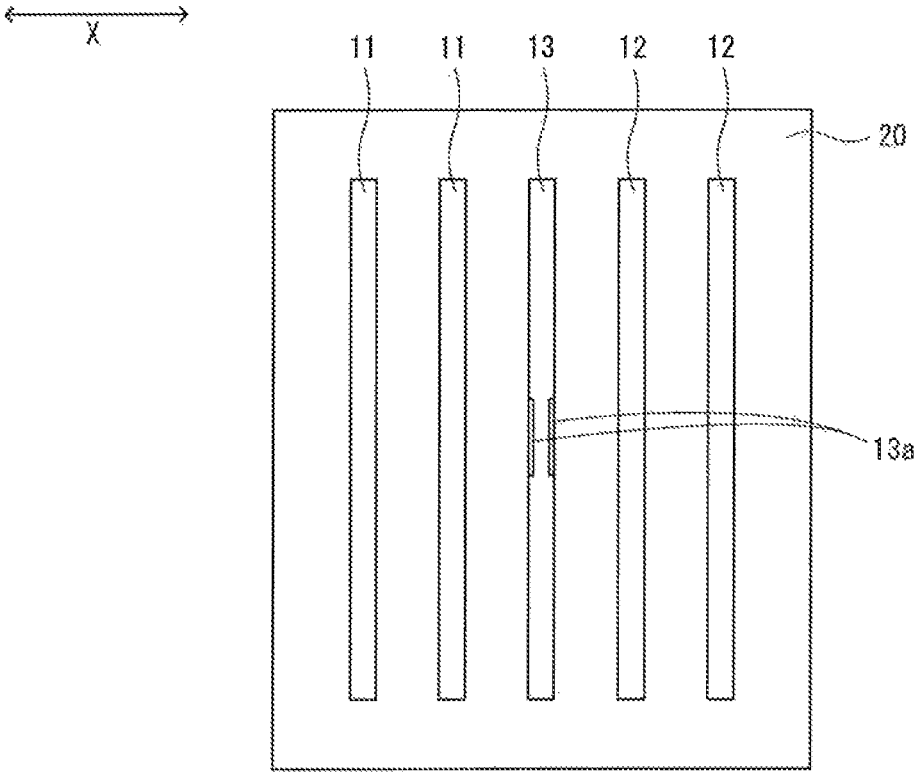
FIG. 11A is a schematic plan view of a signal line structure according to an embodiment of the present invention.
Figure 11B:
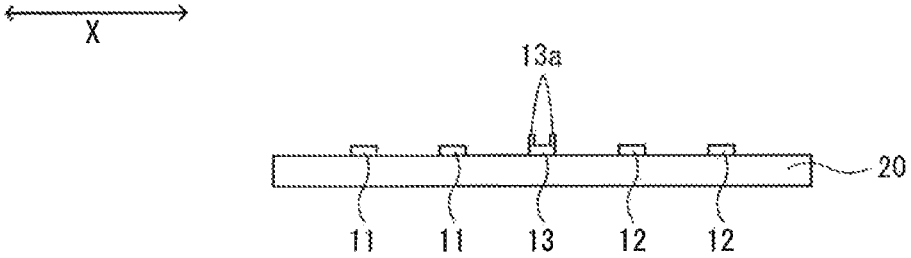
FIG. 11B is a schematic front view of the signal line structure.

In addition, the present invention is not limited to the connectors as described above but is applicable to signal line structures. In this case, the first signal terminals correspond to first signal lines, the second signal terminals correspond to second signal lines, and the third terminal corresponds to a third line. FIGS. 11A and 11B illustrate an embodiment of the signal line structure of the invention. Particularly, a pair of first differential signal lines 11, a pair of second differential signal lines 12, and a GND line 13 (the third line) are arranged in a row along the first direction X on or inside a circuit board 20. The pair of first differential signal lines 11 are adjacent to each other in the first direction X. The pair of second differential signal lines 12 are also adjacent to each other in the first direction X. The GND line 13 is disposed between the inner one of the first differential signal lines 11 and the inner one of the second differential signal lines 12. A portion of the GND line 13 is provided with shielding portions 13*a* extending in the direction crossing the first direction X. The shielding portions 13*a* may have the same configuration as an embodiment of the shielding portions of the connector (see FIGS. 7A and 7B, and FIGS. 9A to 10C).

REFERENCE SIGNS LIST

100 . . . Body
- 100*a* . . . Main body
- 100*b* . . . Cover

T1 . . . First terminal group
- 210*a* . . . Terminal
- 220*a* . . . Terminal T2 . . . Second terminal group
- 210*b* . . . Differential signal terminal (first signal terminal)
  - 211*b* . . . Retention portion
  - 212*b* . . . Contact portion
  - 213*b* . . . Hanging portion
  - 214*b* . . . Tail
- 220*b* . . . Differential signal terminal (first signal terminal)
  - 221*b* . . . Retention portion
  - 222*b* . . . Contact portion
  - 223*b* . . . Hanging portion
  - 224*b* . . . Tail
- 230*b* . . . Differential signal terminal (second signal terminal)
  - 231*b* . . . Retention portion
  - 232*b* . . . Contact portion
  - 233*b* . . . Hanging portion
- 234*b* . . . Tail
- 240*b* . . . Differential signal terminal (second signal terminal)
  - 241*b* . . . Retention portion
  - 242*b* . . . Contact portion
  - 243*b* . . . Hanging portion
  - 244*b* . . . Tail
- 250*b* . . . Ground terminal (third terminal)
  - 251*b* . . . Retention portion
  - 252*b* . . . Contact portion
  - 253*b* . . . Hanging portion
    - 253*b*1 . . . Extended portion
    - 53*b*2 . . . Shielding portion
  - 254*b* . . . Tail

300 . . . Shield case.

X . . . First direction

Y . . . Second direction

Z . . . Third direction

The invention claimed is:

1. A connector comprising:

a body having insulation properties; and a terminal group being arrayed in a first direction and including a pair of first signal terminals of generally L-shape, a second signal terminal of generally L-shape, and a third terminal of generally L-shape that are arrayed in a row along the first direction in the body, wherein the first signal terminals are adjacent to each other in the first direction, the first signal terminals each including:

a first portion extending in a second direction perpendicular to the first direction, and a second portion extending in a third direction crossing the first and second directions, the second signal terminal includes:

a first portion extending in the second direction, and a second portion extending in the third direction, and the third terminal is disposed between one of the first signal terminals and the second signal terminal, the third terminal including:

a first portion extending in the second direction, a second portion extending in the third direction, and a shielding portion-being provided at the second portion of the third terminal, extending in a direction crossing the first and third directions, and being configured to shield electromagnetic waves radiated at an angle with respect to the first direction from the first signal terminal or the second signal terminal.

2. The connector according to claim 1, wherein the second signal terminal of the terminal group comprises a pair of second signal terminals adjacent to each other in the first direction, and the third terminal is disposed between the one of the first signal terminals and one of the second signal terminals.

3. The connector according to claim 1, wherein the first portions of the first and second signal terminals each include:

a retention portion extending in the second direction, being held in the body, and including first and second ends in the second direction, and a contact portion extending in the second direction from the first end of the retention portion, the second portions of the first and second signal terminals each include a hanging portion extending in the third direction from the second end of the retention portion, the first portion of the third terminal includes:

a retention portion extending in the second direction, being held in the body, and including first and second ends in the second direction, and a contact portion extending in the second direction from the first end of the retention portion, the second portion of the third terminal includes a hanging portion extending in the third direction from the second end of the retention portion, and at least one of relations "$\delta1>\gamma1$" and "$\delta2>\gamma2$" holds true, where $\gamma1$ is a distance in the first direction between the hanging portions of the first signal terminals, $\gamma2$ is a distance in the first direction between the retention portions of the first signal terminals, $\delta1$ is a distance in the first direction between the hanging portion of the third terminal and the hanging portion of each of the first and second signal terminals adjacent to the third terminal, and $\delta2$ is a distance in the first direction between the retention portion of the third terminal and the retention portion of each of the first and second signal terminals adjacent to the third terminal.

4. The connector according to claim 1, wherein the shielding portion is a cut-raised section formed by cutting and raising the second portion of the third terminal.

5. The connector according to claim 4, wherein the second portion of the third terminal includes:

an extended portion extending in the first direction; and a remaining portion excluding the extended portion, and the extended portion has a larger dimension in the first direction than the remaining portion.

6. The connector according to claim 4, a relation "$\beta>\alpha$" holds true, where $\beta$ is a distance in the first direction between a centerline of said second portion of the third terminal and a centerline of a portion of each of the first and second signal terminals adjacent to the second portion of the third terminal, a is a distance in the first direction between the centerlines of the portions of the first signal terminals.

7. The connector according to claim 4, wherein the first signal terminals each have a curved portion that is curved to one side in the first direction to detour the second portion of the third terminal, and the second signal terminal has a curved portion that is curved to the other side in the first direction to detour the second portion of the third terminal.

8. The connector according to claim 4, wherein the first portions of the first and second signal terminals each include:

a retention portion extending in the second direction, being held in the body, and including first and second ends in the second direction, and a contact portion extending in the second direction from the first end of the retention portion, the second portions of the first and second signal terminals each include a hanging portion extending in the third direction from the second end of the retention portion, the first portion of the third terminal includes:

a retention portion extending in the second direction, being held in the body, and including first and second ends in the second direction, and a contact portion extending in the second direction from the first end of the retention portion, and the second portion of the third terminal includes a hanging portion extending in the third direction from the second end of the retention portion.

9. The connector according to claim 1, wherein the shielding portion is a bent section being continuous with and bent with respect to the second portion of the third terminal.

10. The connector according to claim 9, wherein the second portion of the third terminal includes:

an extended portion extending in the first direction; and a remaining portion excluding the extended portion, and the extended portion has a larger dimension in the first direction than the remaining portion.

11. The connector according to claim 9, a relation "$\beta>\alpha$" holds true, where $\beta$ is a distance in the first direction between a centerline of said second portion of the third terminal and a centerline of a portion of each of the first and second signal terminals adjacent to the second portion of the third terminal, a is a distance in the first direction between the centerlines of the portions of the first signal terminals.

12. The connector according to claim 9, wherein the first signal terminals each have a curved portion that is curved to one side in the first direction to detour the second portion of the third terminal, and the second signal terminal has a curved portion that is curved to the other side in the first direction to detour the second portion of the third terminal.

13. The connector according to claim 9, wherein the first portions of the first and second signal terminals each include:

a retention portion extending in the second direction, being held in the body, and including first and second ends in the second direction, and a contact portion extending in the second direction from the first end of the retention portion, the second portions of the first and second signal terminals each include a hanging portion extending in the third direction from the second end of the retention portion, the first portion of the third terminal includes:

a retention portion extending in the second direction, being held in the body, and including first and second ends in the second direction, and a contact portion extending in the second direction from the first end of the retention portion, and the second portion of the third terminal includes a hanging portion extending in the third direction from the second end of the retention portion.

* * * * *